US010549406B2

(12) United States Patent
Hu

(10) Patent No.: US 10,549,406 B2
(45) Date of Patent: Feb. 4, 2020

(54) OPEN END WRENCH CAPABLE OF FAST DRIVING AND HAVING HIGH TOUGHNESS AND A LONG SERVICE LIFE

(71) Applicant: Bobby Hu, Taichung (TW)

(72) Inventor: Bobby Hu, Taichung (TW)

( * ) Notice: Subject to any disclaimer, the term of this patent is extended or adjusted under 35 U.S.C. 154(b) by 185 days.

(21) Appl. No.: 15/876,275

(22) Filed: Jan. 22, 2018

(65) Prior Publication Data

US 2018/0222019 A1 Aug. 9, 2018

(30) Foreign Application Priority Data

Feb. 7, 2017 (TW) ..... 106103936 A

(51) Int. Cl.
*B25B 13/46* (2006.01)
*B25B 23/00* (2006.01)

(52) U.S. Cl.
CPC ..... *B25B 13/46* (2013.01); *B25B 23/0071* (2013.01)

(58) Field of Classification Search
CPC ..... B25B 13/08; B25B 13/46; B25B 23/0071
See application file for complete search history.

(56) References Cited

U.S. PATENT DOCUMENTS 4,158,975 A 6/1979 DeSouza
8,402,866 B2 * 3/2013 Hu ..... B25B 13/46 81/179
8,408,100 B2 * 4/2013 Liu ..... B25B 13/46 81/179
8,408,101 B2 * 4/2013 Liu ..... B25B 13/46 81/179
8,413,554 B2 * 4/2013 Lee ..... B25B 13/46 81/179
8,534,167 B2 * 9/2013 Liu ..... B25B 13/46 81/179
8,567,289 B2 * 10/2013 Hu ..... B25B 13/46 81/177.85
8,573,095 B2 * 11/2013 Hu ..... B25B 13/46 81/177.85
8,826,783 B2 * 9/2014 Hu ..... B25B 13/08 81/179
9,381,623 B1 * 7/2016 Yang ..... B25B 13/46
2008/0066585 A1 3/2008 Chiang
2010/0071516 A1 3/2010 Wu
2010/0083797 A1 4/2010 Lee
2013/0239758 A1 * 9/2013 Yang ..... B25B 13/46 81/179

* cited by examiner

*Primary Examiner* — David B. Thomas
(74) *Attorney, Agent, or Firm* — Alan D. Kamrath; Mayer & Williams PC

(57) ABSTRACT

An open end wrench includes a body having a jaw portion for holding a workpiece. The jaw portion includes an arcuate sliding groove, an expanding groove, and a slider movable relative to the arcuate sliding groove along an arcuate path. The jaw includes a first jaw having a force-applying face and an evasive portion adjacent to the force-applying face. When the jaw portion deforms elastically while wrenching the workpiece, the expanding groove increases the expanding effect within an elastic limit of the jaw portion, such that a corner between the force-receiving face in a first rotating direction and a sixth force-receiving face in a second rotating direction can move across the force-applying face into the evasive portion, avoiding damage to the slider and the first jaw resulting from failure in withstanding the reactive force from the workpiece. Thus, the open end wrench has high toughness and a long service life.

20 Claims, 14 Drawing Sheets

OPEN END WRENCH CAPABLE OF FAST DRIVING AND HAVING HIGH TOUGHNESS AND A LONG SERVICE LIFE

BACKGROUND OF THE INVENTION

The present invention relates to an open end wrench and, more particularly, to an open end wrench capable of fast driving and having high toughness and a long service life, with the open end wrench including a jaw portion having an increased elastic deforming effect when the jaw portion is subject to a reactive force from a workpiece, avoiding damage to a slider and the jaw portion resulting from failure to withstand the reactive force form the workpiece.

U.S. Pat. No. 4,158,975 and U.S. Publication Nos. 2008/0066585; 2010/0071516; and 2010/0083797 disclose open end wrenches with a limited torque capacity. To provide a ratcheting effect, a pawl or a slider movable relative to a wrench body is provided to hold a workpiece. However, in an operation requiring a high torque, the structure of the pawl or the slider cannot withstand the reactive force from the workpiece and is, thus, apt to break.

As an example, when a user finds the torque is insufficient during operation, a metal tube is coupled to the handle to increase the lever arm for the purposes of proceeding with a high-torque wrenching operation. Nevertheless, the wrench body must be drilled to form a hole, a groove, or the like for installing the movable member, such as a pawl or a slider, resulting in a reduction in the structural strength of the wrench body. Thus, the pawl or the slide is apt to be damaged by the reactive force from the workpiece while wrenching the workpiece.

The open end wrench disclosed in U.S. Publication No. 2010/0083797 includes an evaded slot. As shown in FIG. 5, the evaded slot is formed between the supporting surface (153) and the curved slot (16) and is adapted to receive a corner of the bolt (C) while rotating the bolt (C). However, during a high-torque wrenching operation, the open end wrench is apt to brake or damage at the location where the evaded slot is formed.

Conventional open end wrenches are generally increased in the rigidity for withstanding high-torque operations. However, the open end wrench could instantly break when subject to a force approximating 80-100% of the rigidity while wrenching the workpiece without any warning, leading to injury to the user and having a short service life.

Thus, a need exists for a novel open end wrench that mitigates and/or obviates the above disadvantages.

BRIEF SUMMARY OF THE INVENTION

An open end wrench according to the present invention is capable of fast driving a workpiece and has high toughness and a long service life. The workpiece includes an outer periphery having first, second, third, fourth, fifth, and sixth sides respectively having first, second, third, fourth, fifth, and sixth faces in a first rotating direction and respectively having first, second, third, fourth, fifth, and sixth force-receiving faces in a second rotating direction. The first force-receiving face in the first rotating direction and the first force-receiving face in the second rotating direction of the workpiece are coplanar. The first force-receiving face in the first rotating direction and the fourth force-receiving face in the first rotating direction of the workpiece are located at two opposite sides of the workpiece. A corner is formed between the first force-receiving face in the first rotating direction and the sixth force-receiving face in the second rotating direction and has an angle of 120°.

The open end wrench includes a body having a handle and a jaw portion formed on an end of the handle. Spaced first and second jaws are formed on an end of the jaw portion opposite to the handle. The jaw portion includes a throat intermediate the first and second jaws. The first and second jaws and the throat together define a wrenching space adapted to receive the working piece. The first jaw includes a force-applying face facing the wrenching space and the second jaw. An evasive portion is formed between the force-applying face of the first jaw and the throat. The jaw portion further includes an arcuate sliding groove at a side of the second jaw facing the wrenching space. A guiding pin is fixed in the arcuate sliding groove. The jaw portion further includes an expanding groove at a side of the first jaw facing the wrenching space. A slider is slideably received in the arcuate sliding groove and is slideable along an arcuate path. The slider includes a first end and a second end opposite to the first end. The first end of the slider includes a first wrenching face located outside of the arcuate sliding groove. The slider further includes a guiding slot that is arcuate. The guiding pin is received in the guiding slot, preventing the slider from disengaging from the arcuate sliding groove. The guiding slot includes an abutting end. When the slider is in a free position, the abutting end of the guiding slot is in contact with the guiding pin. An elastic device is mounted between the body and the slider and biases the slider to the free position.

When the workpiece is not received in the jaw portion, the slider is in the free position, the first wrenching face of the slider extends into the wrenching space, and the first wrenching face of the slider is not parallel to the force-applying face of the first jaw.

When the jaw portion receives the workpiece but does not drive workpiece, the jaw portion abuts the first force-receiving face in the first rotating direction by the force-applying face of the first jaw, the first end of the slider abuts the fourth force-receiving face in the first rotating direction of the workpiece, and the expanding groove faces the second force-receiving face in the second rotating direction of the workpiece.

When the workpiece is wrenched by the jaw portion and causes deformation of the jaw portion, the expanding groove increases an expansion effect of the jaw portion within an elastic limit of the jaw portion, such that the corner between the first force-receiving face in the first rotating direction and the sixth force-receiving face in the second rotating direction of the workpiece moves across the force-applying face of the first jaw and enters the evasive portion, preventing damage to the slider and the first jaw resulting from failing to withstand a reactive force from the workpiece.

In an example, the throat includes a guiding face facing the wrenching space. A gap is formed between the guiding face of the throat and the second force-receiving face in the first rotating direction. The evasive portion is formed between the force-applying face of the first jaw and the guiding face of the throat. An angle larger than 120° is formed between the guiding face of the throat and an extension plane including the force-applying face, such that after the corner between the first force-receiving face in the first rotating direction and the sixth force-receiving face in the second rotating direction moves across the force-applying face of the first jaw, the workpiece is smoothly movable relative to the wrenching space through the provision of the guiding face and the gap.

In an example, the angle between the guiding face of the throat and the extension plane including the force-applying face is larger than 130°.

In an example, the expanding groove is arcuate and intercommunicates with the arcuate sliding groove. The jaw portion includes a protrusion at an intersection between the arcuate sliding groove and the expanding groove. An end of the arcuate sliding groove adjacent to the expanding groove is not connected to an inner wall of the throat facing the wrenching space.

In an example, the arcuate sliding groove includes a sliding wall that is concave and arcuate. The sliding wall is free of holes, grooves, and recesses and has a concave, arcuate face. The expanding groove includes an expanding wall that is concave and arcuate. The expanding wall is free of holes, grooves, and recesses and has a concave, arcuate face. A curvature of the expanding wall is larger than a curvature of the sliding wall.

In an example, the expanding groove further includes a first retaining wall located at a top of the expanding wall and a second retaining wall located at a bottom of the expanding wall and opposite to the first retaining wall. The first and second retaining walls are parallel to each other. The arcuate sliding groove and the expanding groove have the same height.

In an example, a sliding face is formed on a side of the slider, is convex and arcuate, and is smoothly slideable along the sliding wall of the arcuate sliding groove. The arcuate sliding groove further includes a first supporting wall located at a top of the sliding wall and a second supporting wall located at a bottom of the sliding wall and opposite to the first supporting wall. The first supporting wall and the second supporting wall are parallel to each other. Two ends of the guiding pin are respectively fixed to the first and second supporting wall. The slider includes a top face and a bottom face. The top and bottom faces are symmetrically supported by the first and second supporting walls, avoiding wobbling of the slider while sliding in the arcuate sliding groove along the arcuate path. The guiding slot extends from the top face through the bottom face. The guiding slot is free of holes, grooves, and recesses. The guiding slot further includes a pressing end opposite to the abutting end. Two ends of the elastic device respectively abut the guiding pin and the pressing end of the guiding slot. A grease is applied to the expanding wall and the protrusion of the expanding groove. When the slider slides relative to the arcuate sliding groove along the arcuate path, the grease on the protrusion is drawn by the sliding face to move from the second end of the slider to a position between the sliding face and the sliding wall, reducing sliding friction between the slider and the arcuate sliding groove.

In an example, the first end of the slider includes two wings respectively extending away from the top and bottom faces. Each of the two wings includes inner and outer faces. Each of the inner faces of the two wings is configured to wrench the workpiece. The open end wrench is configured to contact a whole height of a head of the workpiece with the first wrenching face and the two wings of the slider, increasing a contact area between the workpiece and the slider. Each of the outer faces of the two wings is not in contact with the body to avoid friction with the body and to permit smooth, agile, reciprocating movement of the slider, preventing the slider from getting stuck.

In an example, each of the inner faces of the two wings includes an extending face coplanar to the first wrenching face. When the workpiece is wrenched by the jaw portion, the outer faces of the two wings are not in contact with the jaw portion to permit smooth, agile, extending and retracting movements of the slider and to prevent the slider from getting stuck, such that the whole height of the head of the workpiece is in contact with the first wrenching face and each extending face of the slider through each of the two wings, increasing the contact area between the workpiece and the slider.

In an example, when the jaw portion receives the workpiece but does not wrench workpiece, a buffering space is formed between the abutting end of the guiding slot and the guiding pin. The buffering space has an arc length larger than a dimensional tolerance of the workpiece. When the workpiece is wrenched by the jaw portion and causes deformation of the jaw portion, the body rotates relative to the workpiece. The buffering space of the slider avoids the slider from rotating together with the body. When the jaw portion expands elastically, the buffering space of the slider allows the first end of the slider to still abut the fourth force-receiving face in the first rotating direction of the workpiece.

In an example, the arc length of the buffering space is larger than a half of a diameter of the guiding pin.

In an example, when the jaw portion receives the workpiece but does not wrench the workpiece, the second end of the slider abuts the third force-receiving face in the first rotating direction of the workpiece. When the jaw portion expands elastically, the buffering space allows the force-applying face and the first wrenching face to respectively abut the first force-receiving face in the first rotating direction and the fourth force-receiving face in the first rotating direction of the workpiece.

In an example, when the jaw portion receives the workpiece but does not wrench the workpiece, a buffering angle is formed between the first wrenching face of the slider and the fourth force-receiving face in the first rotating direction of workpiece. The buffering angle allows the body and the slider to gradually rotate relative to the workpiece when the jaw portion expands elastically, such that the first wrenching face of the slider abuts the fourth force-receiving face in the first rotating direction of the workpiece, providing a surface contact between the first wrenching face of the slider and the fourth force-receiving face in the first rotating direction of the workpiece.

In an example, the buffering angle is larger than 2° and smaller than 4°.

In an example, the first wrenching face of the slider includes at least one V-shaped toothed groove. The at least one V-shaped toothed groove increases friction between the first wrenching face of the slider and the fourth force-receiving face in the first rotating direction of workpiece.

In an example, a sliding face is formed on a side of the slider, is convex and arcuate, and is smoothly slideable along the sliding wall of the arcuate sliding groove. The second end of the slider includes a second wrenching face located outside of the arcuate sliding groove. The first and second wrenching faces are formed at a side of the slider opposite to the sliding face. The slider further includes an evasive portion between the first and second wrenching faces. The evasive portion of the slider is configured to permit entrance of the third force-receiving face in the second rotating direction of the workpiece.

In an example, the sliding face of the slider has a curvature identical to a curvature of the sliding wall of arcuate sliding groove to allow smooth sliding of the sliding face on the sliding wall. When the slider is subject to a reactive force from the workpiece, the reactive force from the workpiece is transmitted to the sliding wall through a large area of the sliding face when the workpiece is wrenched by the body while avoiding stress concentration of the sliding and thereby increasing a torque bearing capacity of the slider.

In an example, the guiding slot has a curvature identical to the curvature of the sliding wall of the arcuate sliding groove, providing smooth arcuate sliding movement between the guiding slot of the slider and the guiding pin in the arcuate sliding groove, and avoiding interference between the slider, the guiding pin and the sliding wall.

In an example, the first and second jaws are integrally formed on the two ends of the jaw portion and opposite to each other. A width of the second jaw in a width direction is larger than a width of the first jaw in the width direction to provide the jaw portion with good structural toughness, thereby increasing a torque bearing capacity of the jaw portion.

In an example, the elastic device includes an elastic element mounted in the guiding slot. The top and bottom faces of the slider are parallel to each other and have a height therebetween in a height direction of the slider perpendicular to the width direction. The height of the slider is smaller or equal to the height of the arcuate sliding groove. The guiding slot has a slot height in the height direction of the slider equal to the height of the slider. The guiding slot has a width. The width of the guiding slot is larger than or equal to a diameter of the guiding pin. The slot height of the guiding slot is larger than 1.5 times the width of the guiding slot. The elastic element of the elastic device in the guiding slot has a height in the height direction of the slider not larger than the slot height of the guiding slot. The height of the elastic element is larger than the width of the guiding slot and larger than 0.5 times the slot height of the guiding slot. The elastic element is a resilient plate having a plurality of force-accumulating units each in a form of a metal sheet. Each of the plurality of force-accumulating units has V-shaped cross sections. Each of the plurality of force-accumulating units includes a first end, a second end and a compressing portion between the first and second ends. The compressing portion is configured to store energy after the first and second ends are compressed, such that each of the plurality of force-accumulating units has an elastic storing ability. The first end of each of the plurality of force-accumulating units is connected to the second end of another of the plurality of force-accumulating units, such that the compressing portion of each of the plurality of force-accumulating units has the elastic storing ability. One of first ends at an end of the elastic element abuts the guiding pin. One of the second ends at another end of the elastic element abuts the pressing end of the guiding slot.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
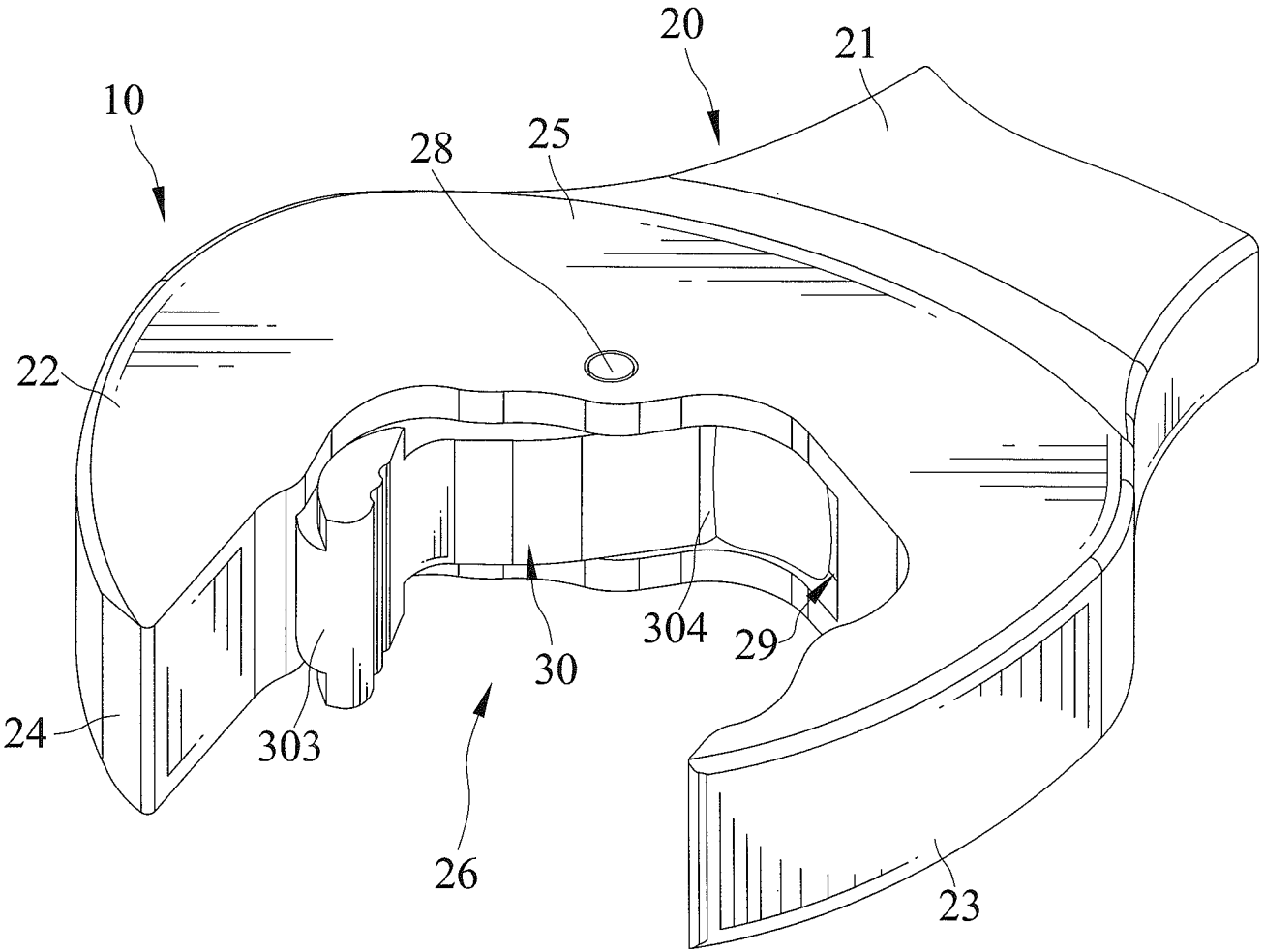
FIG. 1 is a partial, perspective view of an open end wrench according to the present invention.

All figures are drawn for ease of explanation of the basic teachings of the present invention only; the extensions of the figures with respect to number, position, relationship, and dimensions of the parts to form the embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "fourth", "fifth", "sixth", "top", "bottom", "inner", "outer", "side", "end", "portion", "section", "spacing", "clockwise", "counterclockwise", "width", "height", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

Figure 2:
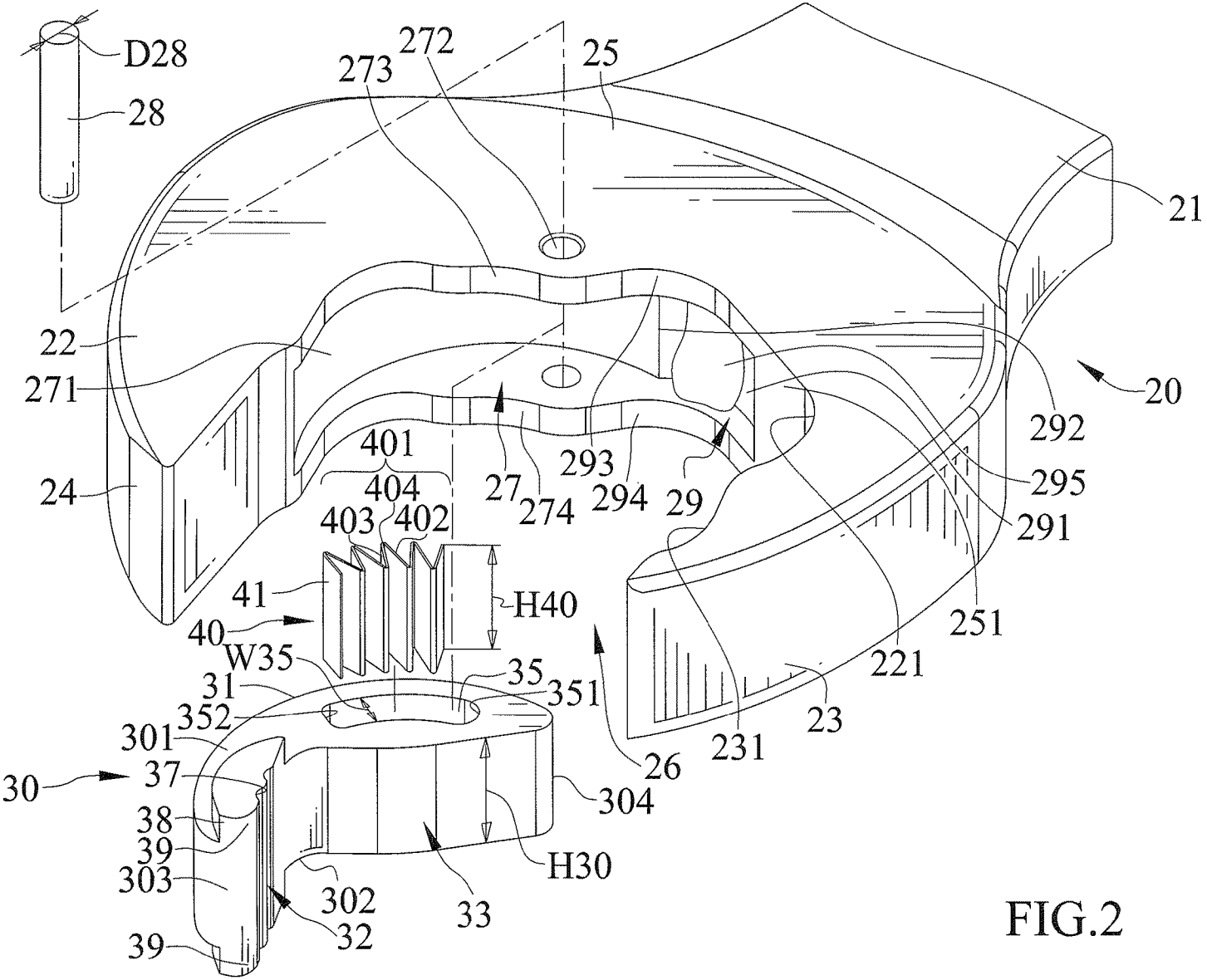
FIG. 2 is a partial, exploded, perspective view of the open end wrench of FIG. 1.
Figure 3:
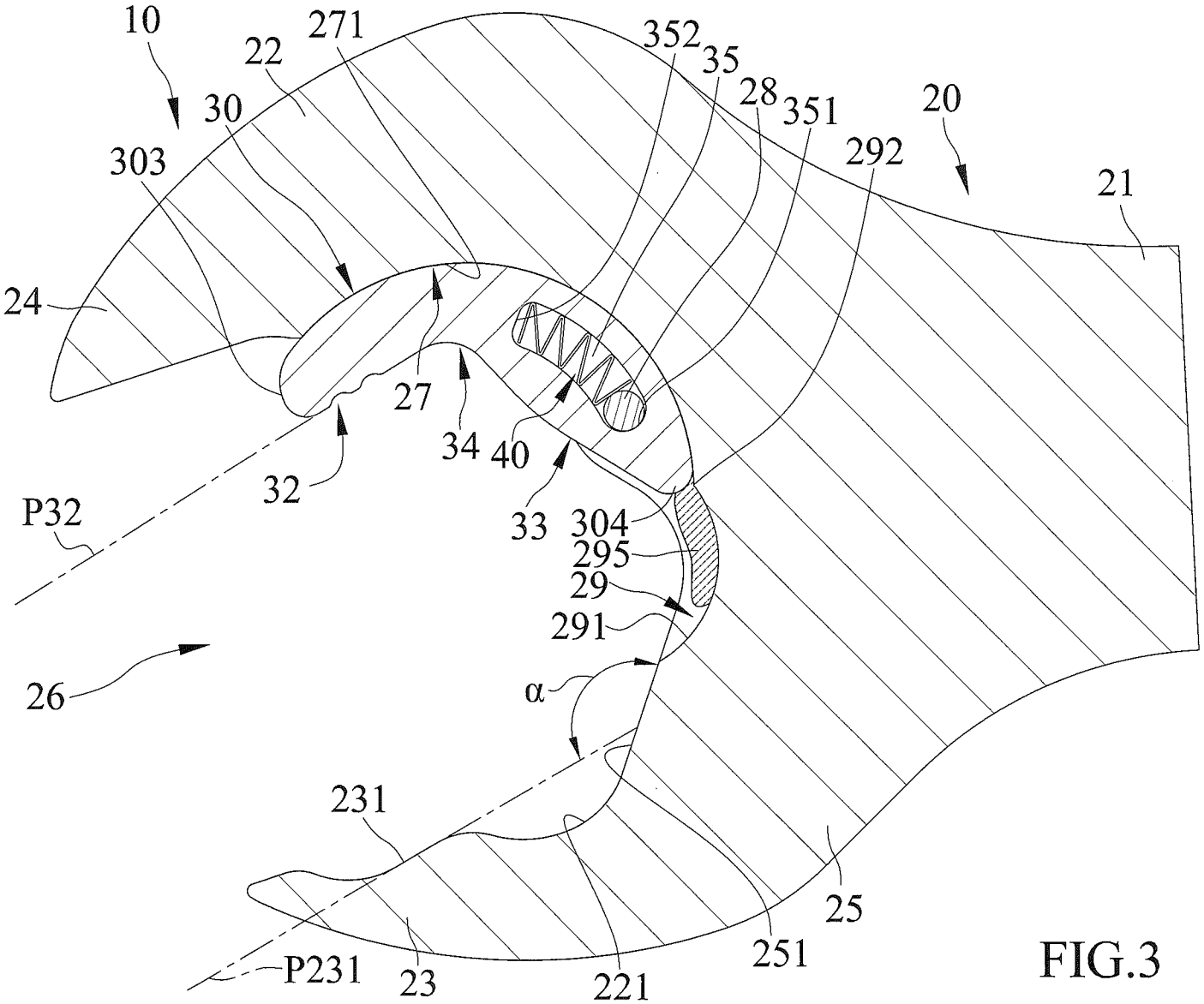
FIG. 3 is a partial, cross sectional view of the open end wrench of FIG. 1, illustrating a slider in a free position.

With reference to FIGS. 1-3, an open end wrench 10 capable of fast driving and having high toughness and a long service life according to the present invention includes a body 20, a slider 30, and an elastic device 40.

Body 20 includes a handle 21 and a jaw portion 22 formed on an end of handle 21. Jaw portion 22 can hold a workpiece 90 (FIG. 4), such as a hexagonal head of a bolt, a nut, or the like. When the workpiece 90 is the hexagonal head of the bolt, the nut or the like, workpiece 90 includes an outer periphery having first, second, third, fourth, fifth, and sixth sides respectively having first, second, third, fourth, fifth, and sixth faces 91A, 92A, 93A, 94A, 95A, and 96A in a first rotating direction and respectively having first, second, third, fourth, fifth, and sixth force-receiving faces 91B, 92B, 93B, 94B, 95B, and 96B in a second rotating direction reverse to the first rotating direction. Thus, a face in the first rotating direction and a face in the second rotating direction on the same side are coplanar. For example, first force-receiving face 91A in the first rotating direction and first force-receiving face 91B in the second rotating direction of workpiece 90 are coplanar. Fourth force-receiving face 94A in the first rotating direction and fourth force-receiving face 94B in the second rotating direction of workpiece 90 are coplanar. Fifth force-receiving face 95A in the first rotating direction and fifth force-receiving face 95B in the second rotating direction of workpiece 90 are coplanar. A corner C is formed between a face in the first rotating direction and a face in the second rotating direction (with the face in the second direction designated by a reference number different from that of the face in the first rotating direction and with the face in the first rotating direction located adjacent to the face in the second rotating direction) has an angle of 120°. For example, a corner C is formed between first force-receiving face 91A in the first rotating direction and sixth force-receiving face 96B in the second rotating direction.

Another corner C is formed between second force-receiving face 92B in the second rotating direction and third force-receiving face 93A in the first rotating direction. A further corner C is formed between fifth force-receiving face 95B in the second rotating direction and sixth force-receiving face 96A in the first rotating direction. A user can grip handle 21 of body 20 and rotates body 20 to create a torque, such that jaw portion 22 rotates around a central axis of workpiece 90, thereby wrenching workpiece 90.

Spaced first and second jaws 23 and 24 are formed on an end of the jaw portion 22 opposite to the handle 21. First and second jaws 23 and 24 can withstand a reactive force from workpiece 90. First and second jaws 23 and 24 are integrally formed on two sides of jaw portion 22 and are opposite to each other. A width of second jaw 24 in a width direction is larger than a width of first jaw 23 in the width direction, such that first jaw 23 and second jaw 24 do not move relative to each other, providing jaw portion 22 with a good structural strength, thereby increasing a torque bearing capacity of jaw portion 22. In an operation requiring a high torque, first jaw 23 withstands the stress (which is the reactive force produced by wrenching workpiece 90) can elastically deform earlier than second jaw 24.

Jaw portion 22 includes a throat 25 intermediate first and second jaws 23 and 24. First and second jaws 23 and 24 and throat 25 together define a wrenching space 26 that is substantially hexagonal. Jaw portion 22 can allow workpiece 90 to enter wrenching space 26 in a radial direction of workpiece 90. Alternatively, jaw portion 22 can allow workpiece 90 to enter wrenching space 26 in a direction parallel to the central axis of workpiece 90. Since first jaw 23 and second jaw 24 do not move relative to each other, the size of wrenching space 26 cannot be adjusted.

Figure 4:
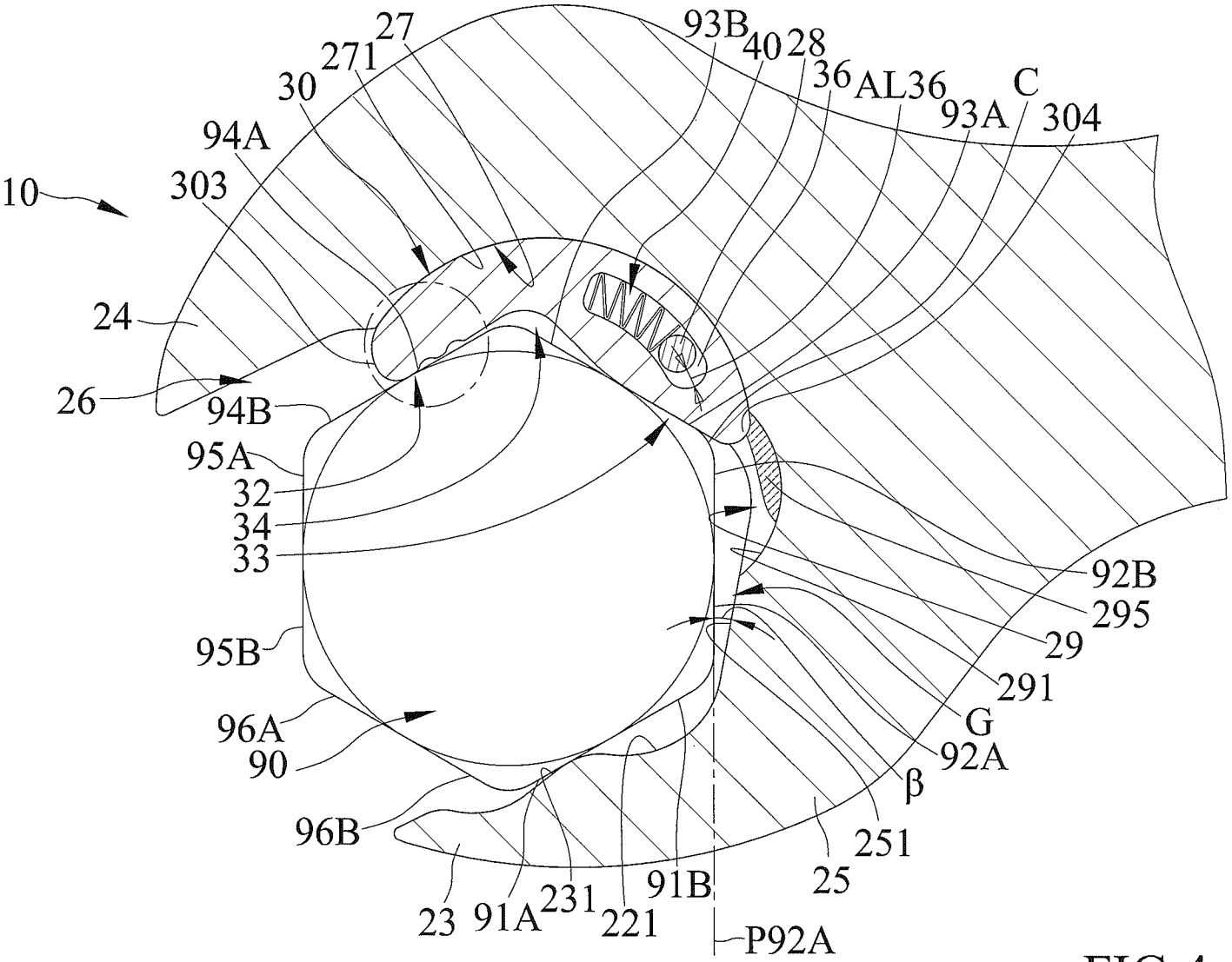
FIG. 4 is a cross sectional view illustrating use of the open end wrench of FIG. 1 on a workpiece that has not been wrenched.

First jaw 23 includes a force-applying face 231 facing wrenching space 26 and a distal end of second jaw 24. In this embodiment, force-applying face 231 faces first force-receiving face 91A in the first rotating direction of workpiece 90 received in wrenching space 26. Throat 25 includes a guiding face 251 facing wrenching space 26. Guiding face 251 can be a flat face. An angle α larger than 120° is formed between guiding face 251 of throat 25 and an extension plane P231 including force-applying face 231. Furthermore, angle α between guiding face 251 of throat 25 and extension plane P231 including force-applying face 231 can be larger than 130° and smaller than 140°. With reference to FIG. 4, guiding face 251 of throat 25 faces second force-receiving face 92A in the first direction of workpiece 90. A gap G is formed between guiding face 251 of throat 25 and second force-receiving face 92A in the first rotating direction, avoiding throat 25 from applying a force on workpiece 90 and preventing from forcing workpiece 90 to escape from wrenching space 26 during wrenching of workpiece 90. An angle 1 larger than 0° is formed between an extension face P92A of second force-receiving face 92A in the first rotating direction and guiding face 251 of throat 25. By such an arrangement, workpiece 90 can guide corner C of workpiece 90 to smoothly move workpiece 90 relative to wrenching space 26 while wrenching workpiece 90.

An evasive portion 221 is formed between force-applying face 231 of first jaw 23 and guiding face 251 of throat 25. Evasive portion 221 permits entrance of first force-receiving face 91A in the first rotating direction, first force-receiving face 91B in the second rotating direction, and sixth force-receiving face 96B in the second rotating direction of workpiece 90.

Jaw portion 22 further includes an arcuate sliding groove 27 at a side of second jaw 24 facing wrenching space 26. Arcuate sliding groove 27 includes a sliding wall 271 that is concave and arcuate. Sliding wall 271 is free of holes, grooves, and recesses, providing a complete concave, arcuate face and enhancing the structural strength of second jaw 24. Thus, jaw portion 22 can withstand a high-torque operation. Furthermore, the center of the concave, arcuate face of sliding wall 271 is located in wrenching space 26, such that arcuate sliding wall 27 can be easily and rapidly processed with a single cutter at low costs while assuring the structural strength of jaw portion 22.

Jaw portion 22 further includes an expanding groove 29 at a side of first jaw 23 facing wrenching space 26. Expanding groove 29 is arcuate and intercommunicates with arcuate sliding groove 27. Thus, an end of arcuate sliding groove 27 adjacent to expanding groove 29 is not connected to an inner wall of throat 25 facing wrenching space 26, thereby increasing the structural strength of jaw portion 22. Expanding groove 29 includes an expanding wall 291 that is concave and arcuate. Expanding wall 291 is free of holes, grooves, and recesses to provide a concave, arcuate face, thereby assuring the structural strength of first jaw 23. The center of the concave, arcuate face of expanding wall 291 is also located in wrenching space 26, such that expanding groove 29 can also be easily and rapidly processed with a single cutter different from the cutter for processing arcuate sliding groove 27 at low costs while assuring the structural strength of jaw portion 22. A curvature of expanding wall 291 is larger than a curvature of sliding wall 271. Thus, the size of the cutter for processing expanding groove 29 is smaller than the size of the cutter for processing arcuate sliding groove 27.

Jaw portion 22 includes a through-hole 272 having circular cross sections. Arcuate sliding groove 27 further includes a first supporting wall 273 located at a top of sliding wall 271 and a second supporting wall 274 located at a bottom of sliding wall 271 and opposite to first supporting wall 273. First and second supporting walls 273 and 274 are parallel to each other. Through-hole 272 is located adjacent to throat 25 and extends through first and second supporting walls 273 and 274. Through-hole 272 receives a guiding pin 28 that is cylindrical. Two ends of guiding pin 28 are respectively fixed to first and second supporting wall 273 and 274 to fix guiding pin 28 in arcuate sliding groove 27. Guiding pin 28 has a diameter D28.

Expanding groove 29 further includes a first retaining wall 293 located at a top of expanding wall 291 and a second retaining wall 294 located at a bottom of expanding wall 291 and opposite to first retaining wall 293. First and second retaining walls 293 and 294 are parallel to each other. By the arrangement of first and second retaining walls 293 and 294, a side of each of first and second retaining walls 293 and 294 facing wrenching space 26 can stop corner C of the workpiece 90 to thereby avoid workpiece 90 from entering expanding groove 29 while wrenching workpiece 90.

Guiding face 251 is a flat surface, and two opposite sides of guiding face 251 are respectively connected to a side of evasive portion 221 and sides of first and second retaining walls 293 and 294, such that an inner wall face of throat 25 facing wrenching space 26 is a substantially smooth face without protrusions or ridges, i.e., a face without any sudden change in the shape, avoiding a sudden increase in the local stress on first jaw 23 and effectively avoiding breaking or destruction of first jaw 23 resulting from stress concentration in a high-torque operation.

Furthermore, the inner wall face of throat 25 facing wrenching space 26 is a substantially smooth face without protrusions or ridges. By such an arrangement, during wrenching of workpiece 90, even if corner C of workpiece 90 comes in contact with the inner wall face of throat 25 facing wrenching space 26, workpiece 90 can still smoothly move relative to wrenching space 26.

In this embodiment, first supporting wall 273 and first retaining wall 293 are coplanar and are located at the top of sliding wall 271 and at the top of expanding wall 291 respectively. Second supporting wall 274 and second retaining wall 294 are coplanar and are located on at the bottom of arcuate sliding wall 271 and at the bottom of expanding wall 291 respectively. Thus, sliding groove 27 and expanding groove 29 have the same height.

Jaw portion 22 further includes a protrusion 292 at an intersection between arcuate sliding groove 27 and expanding groove 29, such that an end of arcuate sliding groove 27 adjacent to expanding groove 29 is not connected to the inner wall face of throat 25 facing wrenching space 26, avoiding reduction of the structural strength of jaw portion 22 after formation of arcuate sliding groove 27 and expanding groove 29. Furthermore, an extension line substantially passes through corner C between fifth force-receiving face 95B in the second rotating direction and sixth force-receiving face 96A in the first rotating direction, corner C between second force-receiving face 92B in the second rotating direction and third force-receiving face 93A in the first rotating direction, and protrusion 292. Thus, protrusion 292 is substantially located in the center of jaw portion 22 and divides jaw portion 22 into two portions in the width direction of jaw portion 22, with the two portions including a first portion having first jaw 23 and a second portion having second jaw 24. Due to the location of protrusion 292 of expanding groove 29, expanding groove 29 increases an expansion effect of the first portion of jaw portion 22 having first jaw 23 within the elastic limit.

Slider 30 is slideably received in arcuate sliding groove 27, is slideable along an arcuate path, and cannot enter expanding groove 29. Slider 30 includes a first end 303 and a second end 304 opposite to first end 303. First and second ends 303 and 304 can wrench workpiece 90. Slider 30 drives workpiece 90 to rotate in a driving direction or slides along a perimeter of workpiece 90 in a reverse direction opposite to the driving direction without driving workpiece 90. Slider 30 is substantially arcuate in cross section and includes a side having a sliding face 31 that is convex and arcuate. Sliding face 31 is slideable along sliding wall 271 of arcuate sliding groove 27, allowing relative arcuate sliding movement between slider 30 and jaw portion 22. Sliding face 31 of slider 30 is free of holes, grooves, and recesses, providing a complete convex, arcuate face and assuring the structural strength of slider 30. Thus, slider 30 can withstand a high-torque operation.

Sliding face 31 of slider 30 has a curvature identical to a curvature of sliding wall 271 of arcuate sliding groove 27 to allow smooth sliding of sliding face 31 on sliding wall 271. Furthermore, due to the identical curvature of sliding face 31 and sliding wall 271, when slider 30 is subject to a reactive force from workpiece 90, the reactive force from workpiece 90 can be transmitted to sliding wall 271 through a large area of sliding face 31 while avoiding stress concentration of sliding 30 and thereby increasing the torque bearing capacity of slider 30 when workpiece 90 is wrenched by body 20.

Figure 3A:
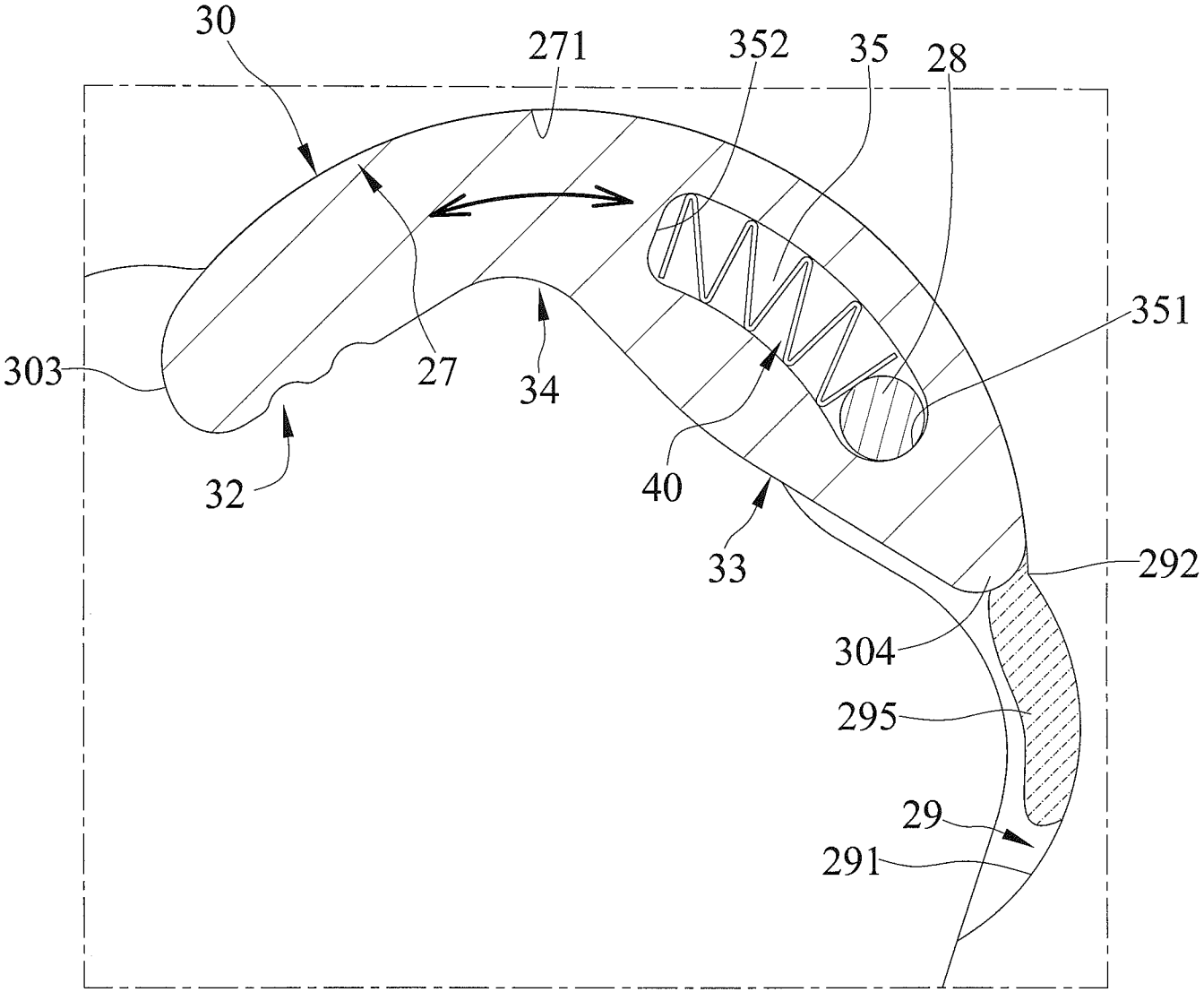
FIG. 3A is a diagrammatic cross sectional view illustrating grease disposed in an expanding groove of the open end wrench of FIG. 1, illustrating a grease applied to an expanding groove.

With reference to FIG. 3A, a grease 295 is applied to expanding wall 291 and protrusion 292 of expanding groove 29. Since protrusion 292 is located at the intersection between expanding groove 29 and arcuate sliding groove 27, when slider 30 slides relative to arcuate sliding groove 27 along the arcuate path, grease 295 on protrusion 292 is drawn by sliding face 31 to move from second end 304 of slider 30 to a position between sliding face 31 and sliding wall 271, effectively reducing the sliding friction between slider 30 and arcuate sliding groove 27. By reducing the sliding friction between slider 30 and arcuate sliding groove 27, in an operation requiring a high torque, when first jaw 23 elastically deforms from wrenching of workpiece 90, grease 295 can avoid breakage of slider 30 caused by excessive stress concentration on slider 30 resulting from excessive sliding friction between slider 30 and arcuate sliding groove 27.

First end 303 of slider 30 includes a first wrenching face 32 located outside of arcuate sliding groove 27. Second end 304 of slider 30 includes a second wrenching face 33 located outside of arcuate sliding groove 27. First and second wrenching faces 32 and 33 are formed at a side of slider 30 opposite to sliding face 31. First wrenching face 32 is at an angle larger than 100° to second wrenching face 33. An evasive portion 34 is formed between first and second wrenching faces 32 and 33 and permits entrance of third force-receiving face 93B in the second rotating direction of workpiece 90.

Slider 30 includes a top face 301 and a bottom face 302. Top and bottom faces 301 and 302 respective contact first and second supporting walls 273 and 274. Top and bottom faces 301 and 302 of slider 30 are parallel to each other and have a height H30 therebetween in a height direction of slider 30 perpendicular to the width direction. Ignoring the tolerance, height H30 of slider 30 is smaller or equal to the height of arcuate sliding groove 27. This allows to top and bottom faces 301 and 302 of slider 30 to be symmetrically supported by first and second supporting walls 273 and 274 of arcuate sliding groove 27, avoiding wobbling of slider 30 while sliding in arcuate sliding groove 27 along the arcuate path and increasing operational stability of open end wrench 10.

Slider 30 further includes a guiding slot 35 that is arcuate. Guiding slot 35 extends from top face 301 through bottom face 302 and has a curvature the same as the curvature of sliding wall 271 of arcuate sliding groove 27. Since guiding slot 35 extends from top face 301 through bottom face 302, guiding slot 35 has a slot height in the height direction of slider 30 equal to height H30 of slider 30. Furthermore, guiding slot 35 has a width W35 (between inner and outer surfaces thereof) in a width direction perpendicular to the height direction of slider 30. Namely, width W35 is equal to a difference between a radius of the outer arcuate surface and a radius of the inner arcuate surface of guiding slot 35. Ignoring the tolerance, width W35 is larger or equal to a diameter D28 of guiding pin 28. The slot height of guiding slot 35 is larger than 1.5 times width W35 of guiding slot 35 (i.e., width W35 of guiding slot 35 is smaller than 0.66 times the slot height of guiding slot 35). In this embodiment, the slot height of guiding slot 35 is larger than two times width W35 of guiding slot 35 (i.e., width W35 of guiding slot 35 is smaller than 0.5 times the slot height of guiding slot 35).

Guiding pin 28 is received in guiding slot 35, preventing slider 30 from disengaging from arcuate sliding groove 27. Since the curvature of sliding face 31 of slider 30 is the same as those of guiding slot 35 and sliding wall 271 of arcuate sliding wall 27, smooth arcuate sliding movement between guiding slot 35 of slider 30 and guiding pin 28 in arcuate sliding groove 27 can be obtained while sliding face 31 of slider 30 is moving along sliding wall 271 of arcuate sliding groove 27 along the arcuate path. Undesired interference between slider 30, guiding pin 28 and sliding wall 271 is avoided.

Guiding slot 35 includes an abutting end 351 and a pressing end 352 opposite to abutting end 351. When slider 30 is in a free position, abutting end 351 is in contact with guiding pin 28, and pressing end 352 is in contact with elastic device 40. Since all of the faces of guiding slot 35 are free of holes, grooves, and recesses, stress concentration is avoided, and the structural strength of slider 30 is assured. Thus, slider 30 can withstand a high-torque operation. Furthermore, since sliding face 31 and all of the faces of guiding slot 35 of slider 30 are free of holes, grooves, and recesses, the processing costs of slider 30 can be reduced while providing open end wrench 10 with a high-torque capacity, allowing open end wrench 10 to be produced at low cost for wider industrial application.

First wrenching face 32 of slider 30 includes at least one V-shaped toothed groove 37. In this embodiment, slider 30 includes two toothed grooves 37. The two toothed grooves 37 increase friction between first wrenching face 32 of slider 30 and fourth force-receiving face 94A in the first rotating direction of workpiece 90.

First end 303 of slider 30 includes two wings 38 respectively extending away from top and bottom faces 301 and 302. Each of the two wings 38 includes inner and outer faces. Each of the inner faces of the two wings 38 is configured to wrench workpiece 90. Open end wrench 10 is configured to contact the whole height of the head of workpiece 90 with first wrenching face 32 and the two wings 38 of slider 30, increasing the contact area between workpiece 90 and slider 30. Each of the outer faces of the two wings 38 is not in contact with body 20 to avoid friction with body 20 and to permit smooth, agile, reciprocating movement of slider 30, preventing slider 30 from getting stuck.

Each of the inner faces of the two wings 38 includes an extending face 39 coplanar to first wrenching face 32. When workpiece 90 is wrenched by jaw portion 22, the outer faces of the two wings 38 are not in contact with jaw portion 22 to permit smooth, agile, extending and retracting movements of slider 30 and to prevent slider 30 from getting stuck.

Elastic device 40 is mounted between body 20 and slider 30 and cannot enter expanding groove 29. Two ends of elastic device 40 respectively abut guiding pin 28 and pressing end 352 of guiding slot 351, biasing slider 30 to the free position. Elastic device 40 includes an elastic element 41 mounted in guiding slot 35. Elastic element 41 of elastic device 40 in guiding slot 35 has a height H40 in the height direction of slider 30 not larger than the slot height of guiding slot 35. Height H40 of elastic element 41 is larger than width W35 of guiding slot 35 and larger than 0.5 times the slot height of guiding slot 35. By providing such an elastic element 41, elastic element 41 will not move away from its initial position in guiding slot 35, reliably returning slider 30 to the free position under the bias of elastic element 41.

In this embodiment, elastic element 41 is a resilient plate having a plurality of force-accumulating units 401 each in a form of a metal sheet. Each of the plurality of force-accumulating units 401 has substantially V-shaped cross sections. Each of the plurality of force-accumulating units 401 includes a first end 402, a second end 403, and a compressing portion 404 between the first and second ends 402 and 403. Compressing portion 404 is configured to store energy after first and second ends 402 and 403 are compressed, such that each of the plurality of force-accumulating units 401 has an elastic returning ability. First end 402 of each of the plurality of force-accumulating units 401 is connected to second end 403 of another of the plurality of force-accumulating units 401, such that compressing portion 404 of each of the plurality of force-accumulating units 401 has the elastic storing ability. One of first ends 402 at an end of elastic element 401 abuts guiding pin 28. One of second ends 403 at the other end of elastic element 401 abuts pressing end 352 of guiding slot 35, allowing slider 30 to return to the free position.

When workpiece 90 is not received in jaw portion 22 (FIG. 3), slider 30 is in the free position. First wrenching face 32 of slider 30 extends into wrenching space 26. First wrenching face 32 of slider 30 is not parallel to force-applying face 231 of first jaw 23. At the same time, abutting end 351 of guiding slot 35 is in contact with guiding pin 28.

With reference to FIG. 3, an extension plane P32 including first wrenching face 32 and an extension plane P231 including force-applying face 231 are not parallel to each other. Thus, extension plane P32 of first wrenching face 32 and extension plane P231 including force-applying face 231 will intersect at an intersection away from handle 21 of body 20.

With reference to FIG. 4, when jaw portion 22 receives workpiece 90 but does not wrench workpiece 90, jaw portion 22 abuts first force-receiving face 91A in the first rotating direction by force-applying face 231 of first jaw 23, and first end 303 of slider 30 abuts fourth force-receiving face 94A in the first rotating direction of workpiece 90. At the same time, a buffering space 36 is formed between abutting end 351 of guiding slot 35 and guiding pin 28. When jaw portion 22 expands elastically, buffering space 36 of slider 30 allows first end 303 of slider 30 to still abut fourth force-receiving face 94A in the first rotating direction of workpiece 90. Since first wrenching face 32 is at an angle larger than 100° to second wrenching face 33, buffering space 36 of slider 30 allows first wrenching face 32 of slider 30 to still abut fourth force-receiving face 94A in the first rotating direction of workpiece 90 during elastic expansion of jaw portion 22.

Buffering space 36 has an arc length AL36. Arc length AL36 of buffering space 36 must be larger than an allowable dimensional tolerance resulting from processing of workpiece 90. Namely, ignoring the slight difference in the dimensional tolerance of workpiece 90 of a certain size, arc length AL36 of the buffering space 36 must be larger than the dimensional tolerance of workpiece 90. Thus, when jaw portion 22 elastically deforms, buffering space 36 effectively assures that first wrenching face 32 of slider 30 still abuts fourth force-receiving face 94A in the first rotating direction of workpiece 90. Preferably, arc length AL36 of buffering space 36 is larger than a half of width W35 of guiding slot 35. Namely, arc length AL36 of buffering space 36 is larger than a half of diameter D28 of guiding pin 28.

With reference to FIG. 4, in this embodiment, workpiece 90 is in the form of a hexagonal bolt and enters wrenching space 26 of jaw portion 22, such that jaw portion 22 abuts first force-receiving face 91A in the first rotating direction by force-applying face 231 of first jaw 23, such that first end 303 of slider 30 abuts fourth force-receiving face 94A in the first rotating direction of workpiece 90, and such that evasive portion 221 permits entrance of first force-receiving face 91B in the second rotating direction of workpiece 90. At the same time, it is noted that buffering space 36 exists between abutting end 351 of guiding slot 35 of slider 30 and guiding pin 28. Furthermore, arc length AL36 of buffering space 36 is larger than the dimensional tolerance of workpiece 90 of its size.

When workpiece 90 enters wrenching space 26 of jaw portion 22, first end 303 of slider 30 is pushed by workpiece 90, such that elastic device 40 in slider 30 is compressed and deformed and such that slider 30 can move relative to body 20 along the arcuate path until workpiece 90 is in contact with second wrenching face 33. At this time, elastic device 40 pushes slider 30 to abut first wrenching face 32 of slider 30 against fourth force-receiving face 94A in the first rotating direction, providing a surface contact therebetween. Arcuate sliding groove 27 faces third force-receiving faces 93A and 93B in the first and second rotating direction and fourth force-receiving faces 94A and 94B in the first and second rotating direction of workpiece 90. Furthermore, expanding groove 29 faces second force-receiving face 92B in the second rotating direction. Since fourth force-receiving face 94A in the first rotating direction and first force-receiving face 91A in the first rotating direction are parallel to each other, first wrenching face 32 of slider 30 is generally parallel to extension plane P231 including force-applying face 231 (shown in FIG. 3). Since an angle $\alpha$ larger than 120° is formed between guiding face 251 of throat 25 and extension plane P231 including force-applying face 231, and since an angle $\beta$ larger than 0° is formed between an extension face P92A including second force-receiving face 92A in the first rotating direction and guiding face 251 of throat 25, throat 25 is not in contact with the workpiece 90 due to provision of the gap G between the guiding face 251 and second force-receiving face 92A in the first rotating direction, avoiding throat 25 from applying a force on workpiece 90 and preventing from forcing workpiece 90 to escape from wrenching space 26 during wrenching of workpiece 90.

Figure 4A:
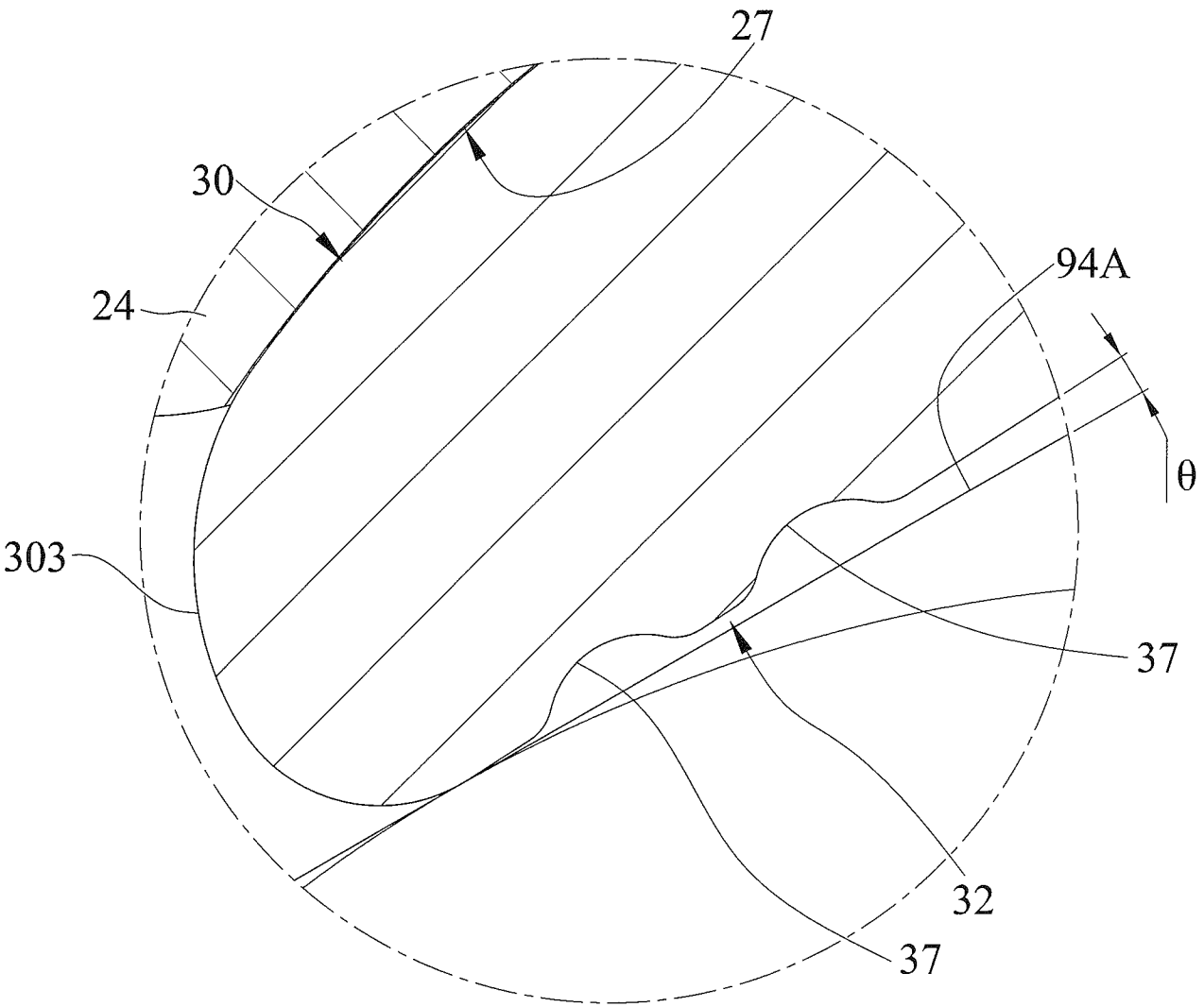
FIG. 4A is an enlarged view of a circled portion of FIG. 4, illustrating a buffering angle between a slider and the workpiece.

With reference to FIG. 4A, when jaw portion 22 receives workpiece 90 but does not wrench workpiece 90, first end 303 of slider 30 abuts fourth force-receiving face 94A in the first rotating direction of workpiece 90, such that a buffering angle $\theta$ is formed between first wrenching face 32 of slider 30 and fourth force-receiving face 94A in the first rotating direction of workpiece 90. Buffering angle $\theta$ is larger than 2° and can be smaller than 5°. Namely, the angle between first and second faces 32 and 33 of slider 30 is smaller than 118°. Buffering angle $\theta$ allows body 20 and slider 30 to gradually rotate relative to workpiece 90 in the clockwise direction when jaw portion 22 expands elastically, such that first wrenching face 32 of slider 30 still abuts fourth force-receiving face 94A in the first rotating direction of workpiece 90.

Figure 5:
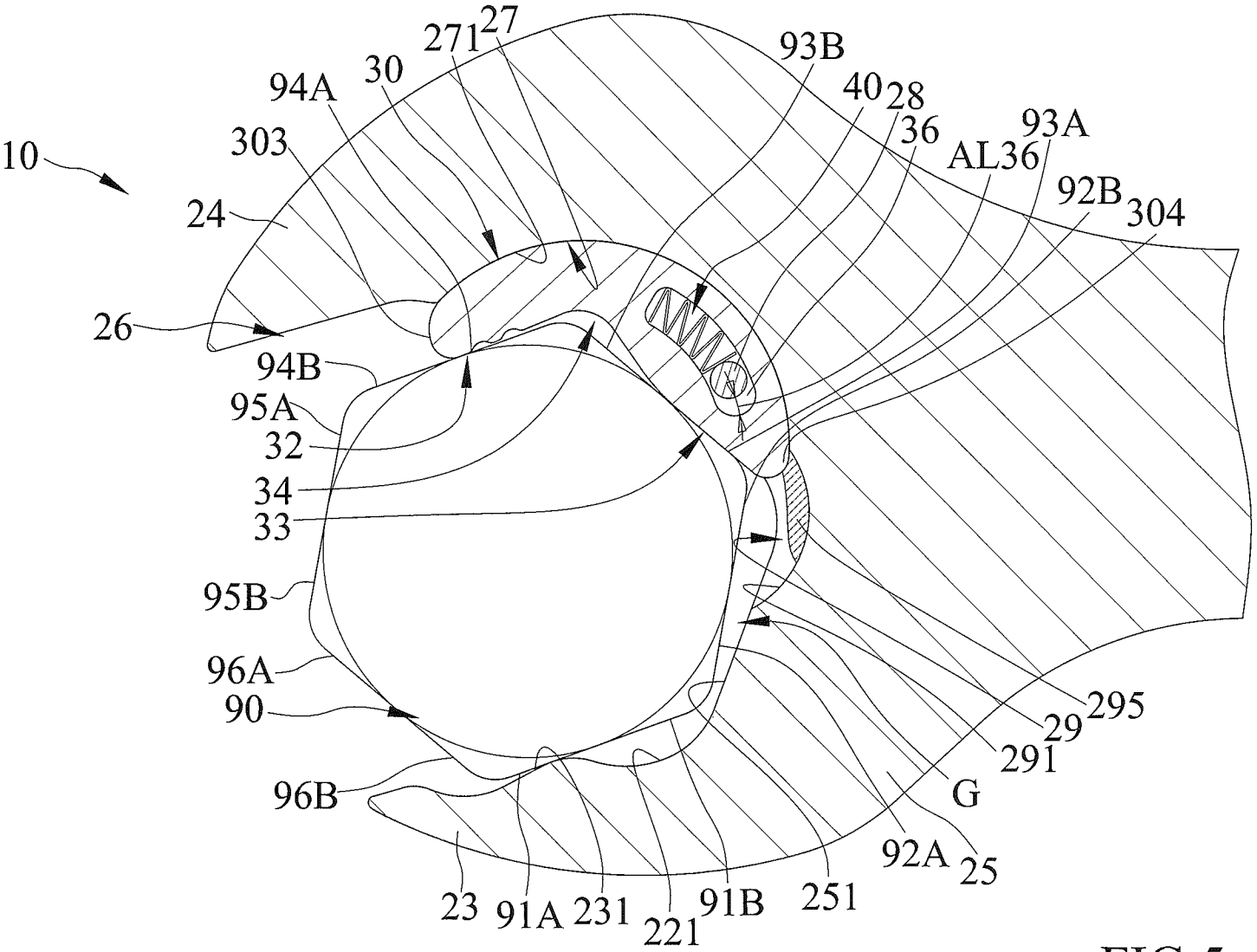
FIG. 5 is a view similar to FIG. 4, with the workpiece driven by the jaw portion to move 10° in a clockwise direction from the position shown in FIG. 4.

With reference to FIG. 5, workpiece 90 is driven by jaw portion 22 to move 10° in the clockwise direction from the position shown in FIG. 4. In this case, the user rotates handle 21 in a direction towards first jaw 23, such that jaw portion 22 rotates around the central axis of workpiece 90. The force applied by the user is transmitted to first force-receiving face 91A in the first rotating direction of workpiece 90 through force-applying face 231 of first jaw 23. At the same time, the force applied by the user is also transmitted to fourth force-receiving face 94A in the first rotating direction of workpiece 90 through first wrenching face 32 of slider 30. Thus, workpiece 90 is rotated by jaw portion 22. During this process, second wrenching face 33 of slider 30 abuts third force-receiving face 93A in the first rotating direction of workpiece 90, providing assistance in driving workpiece 90 to rotate.

Since first jaw 23 and jaw portion 22 are integrally formed as a single and inseparable component of the same material, force-applying face 231 of first jaw 23 can effectively withstand the reactive force from first force-receiving face 91A in the first rotating direction of workpiece 90. Furthermore, since second jaw 24 and jaw portion 22 are integrally formed as a single and inseparable component of the same material and since sliding face 31 of slider 30 and sliding wall 271 of arcuate sliding groove 27 are free of holes, grooves, and recesses, have the same curvature, and are in surface contact with each other, first wrenching face 32 of slider 30 can effectively withstand the reactive force from fourth force-receiving face 94A in the first rotating direction. Thus, open end wrench 10 according to the present invention can withstand a high-torque operation.

Second wrenching face 33 of slider 30 abuts third force-receiving face 93A in the first rotating direction of workpiece 90. Since second jaw 24 and jaw portion 22 are integrally formed as a single and inseparable component of the same material and since sliding face 31 of slider 30 and sliding wall 271 of arcuate sliding groove 27 are free of holes, grooves, and recesses, have the same curvature, and are in surface contact with each other, second wrenching face 33 of slider 30 can effectively withstand the reactive force from third force-receiving face 93A in the first rotating direction. Thus, open end wrench 10 according to the present invention can withstand a high-torque operation.

Figure 6:
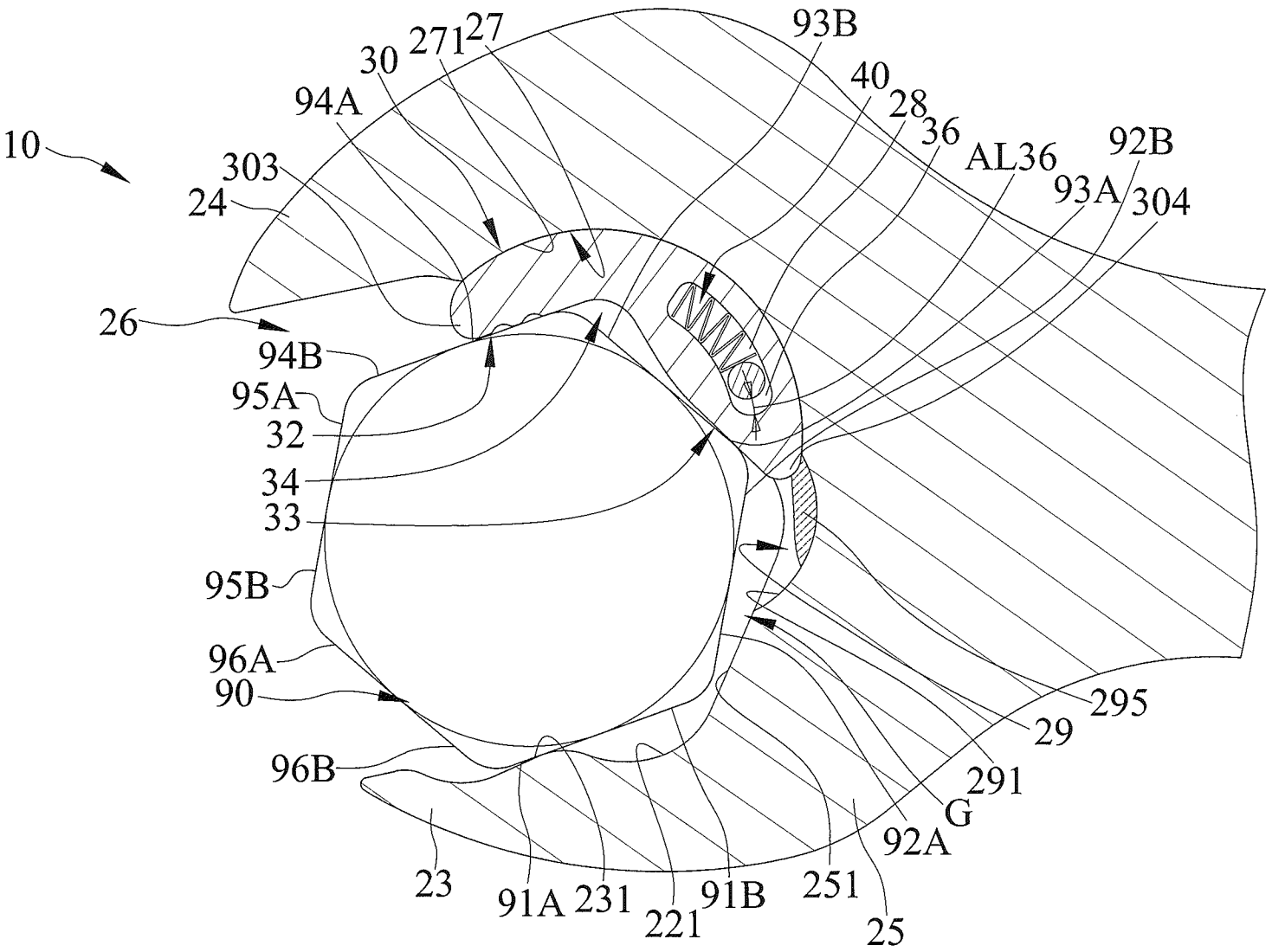
FIG. 6 is a view similar to FIG. 5, illustrating elastic expansion of the jaw portion while wrenching the workpiece.

FIG. 6 is a view similar to FIG. 5, illustrating elastic expansion of jaw portion 22 while wrenching workpiece 90. Specifically, in a demand for a high torque, the user rotates handle 21 and, thus, rotates jaw portion 22 around the central axis of workpiece 90, such that jaw portion 22 is subject to the reactive force of workpiece 90 and starts to elastically deform. At this time, the reactive force imparted to jaw portion 22 is still smaller than the elastic limit of jaw portion 22. Since the width of second jaw 24 in the width direction is larger than the width of first jaw 23 in the width direction, first jaw 23 elastically deforms first, such that the curvature of expanding wall 291 of expanding groove 29 decreases but is still larger than the curvature of sliding wall 271 of arcuate sliding groove 27. At this time, first wrenching face 32 of slider 30 abuts fourth force-receiving face 94A in the first rotating direction of workpiece 90. Furthermore, second wrenching face 33 of slider 30 abuts third force-receiving face 93A in the first rotating direction of workpiece 90. Furthermore, force-applying face 231 of first jaw 23 abuts first force-receiving face 91A in the first rotating direction.

Thus, jaw portion 22 can still stably hold and rotate workpiece 90. Expanding groove 29 faces second force-receiving face 92B in the second rotating direction of workpiece 90. Through provision of angle α (larger than 120°) between guiding face 251 of throat 25 and extension plane P231 including force-applying face 231 (shown in FIG. 3) and through provision of gap G between guiding face 251 of throat 25 and second force-receiving face 92A in the first rotating direction, throat 25 is not in contact with workpiece 90 and, thus, will not apply a force on workpiece 90, avoiding workpiece 90 from escaping from wrenching space 26 during wrenching of workpiece 90, and assisting jaw portion 22 in stably holding workpiece 90. Evasive portion 221 permits entrance of first force-receiving face 91B in the second rotating direction of workpiece 90.

Figure 7:
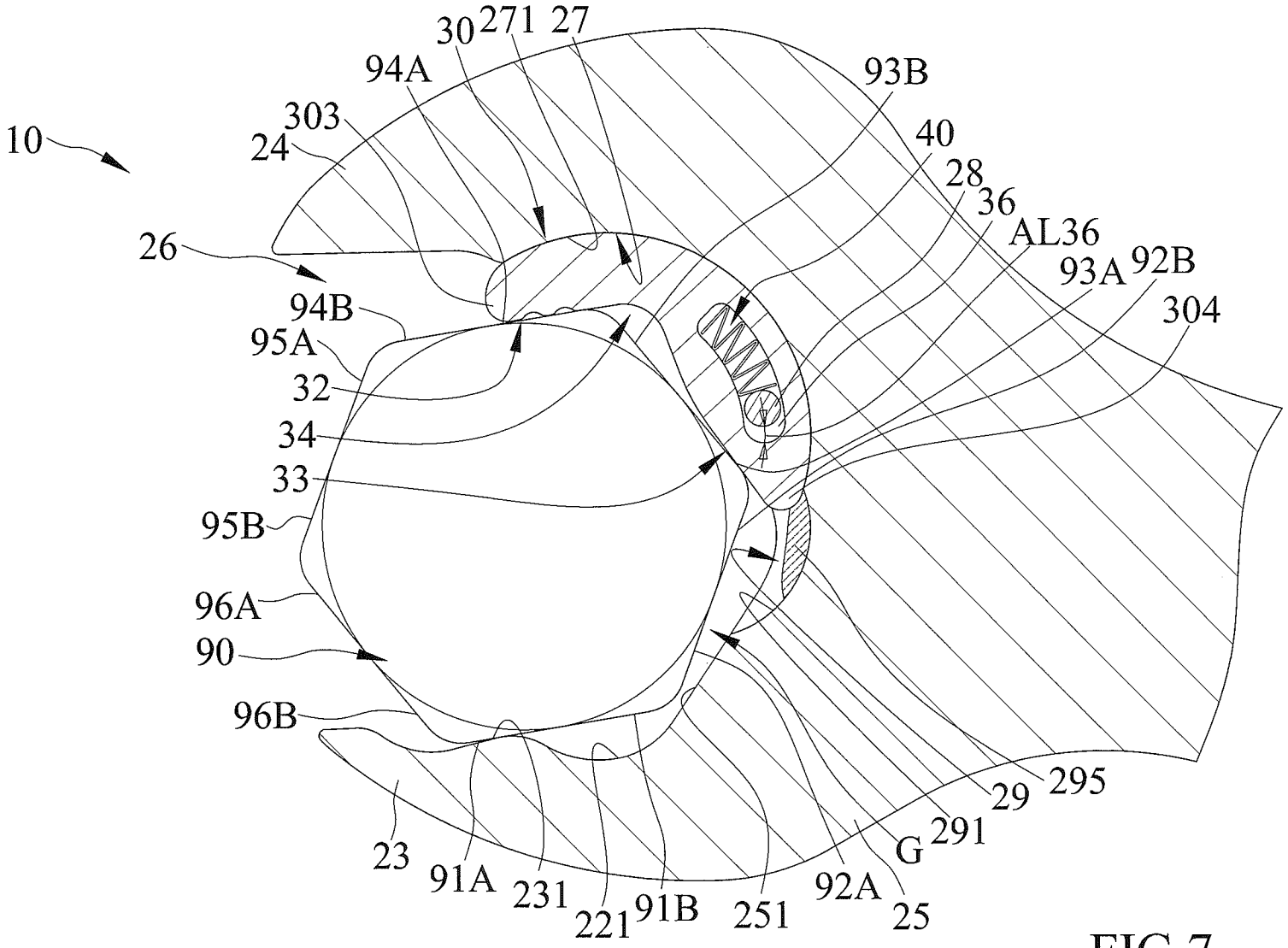
FIG. 7 is a view similar to FIG. 6, with the workpiece driven by the jaw portion to move further 10° in the clockwise direction from the position shown in FIG. 5.

FIG. 7 is a view similar to FIG. 6, with workpiece 90 driven by jaw portion 22 to move further 10° in the clockwise direction from the position shown in FIG. 5. Jaw portion 22 is subject to the reactive force of workpiece 90 and continues to deform elastically. At this time, the reactive force imparted to jaw portion 22 is still smaller than the elastic limit of jaw portion 22. Particularly, the elastic deformation of first jaw 23 continuously increases, such that the curvature of expanding wall 291 of expanding groove 29 continuously decreases to an extent which is smaller than the curvature of expanding wall 291 in FIG. 6 but is still larger than the curvature of sliding wall 271 of arcuate sliding groove 271. At this time, first wrenching face 32 of slider 30 abuts fourth force-receiving face 94A in the first rotating direction of workpiece 90. Second wrenching face 33 of slider 30 abuts third force-receiving face 93A in the first rotating direction of workpiece 90. Force-applying face 231 of first jaw 23 abuts first force-receiving face 91A in the first rotating direction. Thus, jaw portion 22 can still stably hold and rotate workpiece 90. Expanding groove 29 faces second force-receiving face 92B in the second rotating direction of workpiece 90. Through provision of angle α (larger than 120°) between guiding face 251 of throat 25 and extension plane P231 including force-applying face 231 (shown in FIG. 3) and through provision of gap G between guiding face 251 of throat 25 and second force-receiving face 92A in the first rotating direction, throat 25 is not in contact with workpiece 90 and, thus, will not apply a force on workpiece 90, avoiding workpiece 90 from escaping from wrenching space 26 during wrenching of workpiece 90, and assisting jaw portion 22 in stably holding workpiece 90. Evasive portion 221 permits entrance of first force-receiving face 91B in the second rotating direction of workpiece 90.

Figure 8:
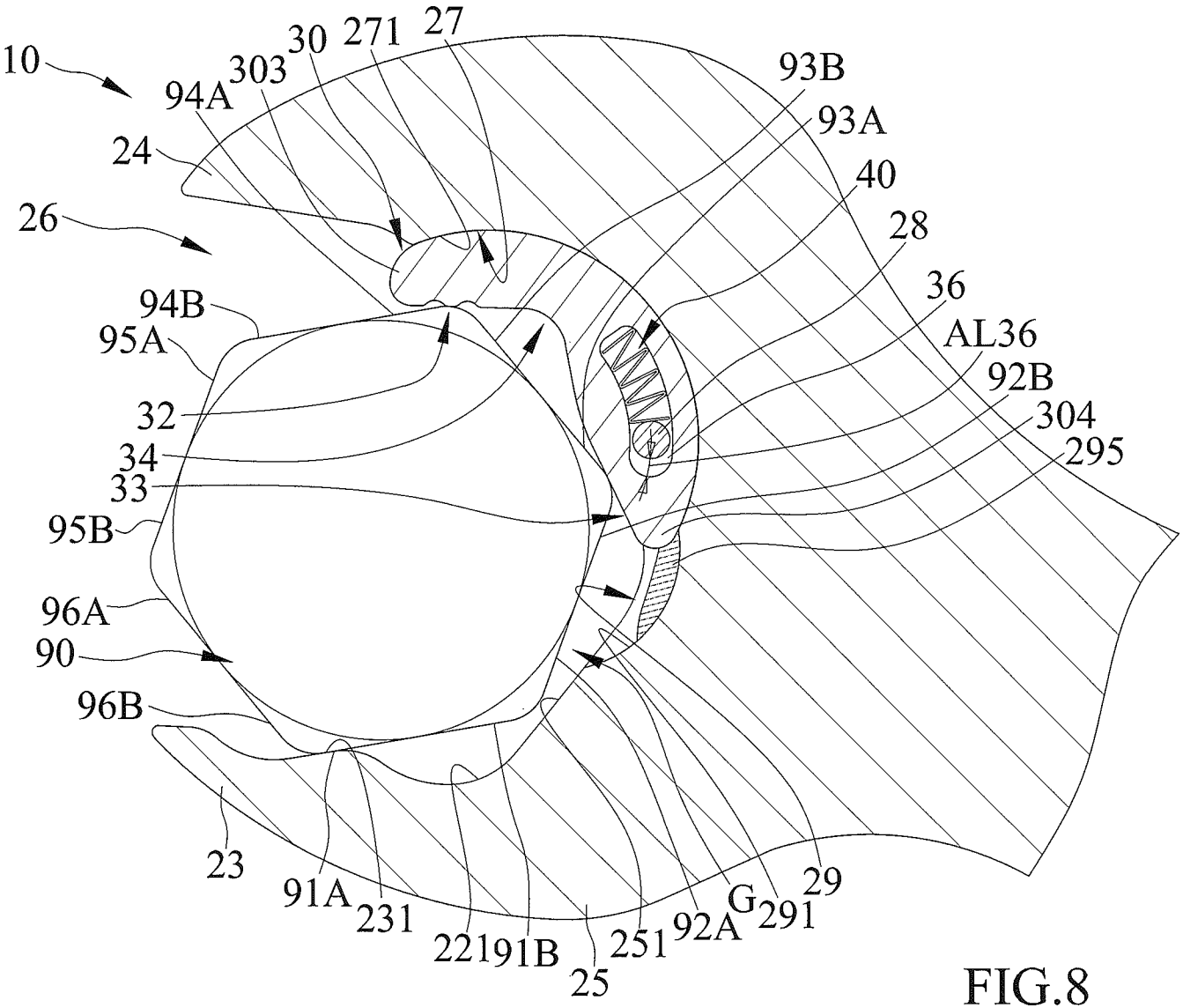
FIG. 8 is a view similar to FIG. 7, illustrating elastic expansion of the jaw portion while wrenching the workpiece.

FIG. 8 is a view similar to FIG. 7, illustrating elastic expansion of jaw portion 22 while wrenching workpiece 90. Specifically, in a demand for a higher torque, the user rotates handle 21 and, thus, rotates jaw portion 22 around the central axis of workpiece 90, such that jaw portion 22 is subject to the reactive force of workpiece 90 and continues to deform elastically. At this time, the reactive force imparted to jaw portion 22 is still smaller than the elastic limit of jaw portion 22. Particularly, the elastic deformation of first jaw 23 continuously increases, such that the curvature of expanding wall 291 of expanding groove 29 continuously decreases to an extent which is smaller than the curvature of expanding wall 291 in the FIG. 7 but is still larger than the curvature of sliding wall 271 of arcuate sliding groove 27. At this time, first wrenching face 32 of slider 30 abuts fourth force-receiving face 94A in the first rotating direction of workpiece 90. Second wrenching face 33 of slider 30 abuts third force-receiving face 93A in the first rotating direction of workpiece 90. Force-applying face 231 of first jaw 23 abuts first force-receiving face 91A in the first rotating direction. Thus, jaw portion 22 can still stably hold and rotate workpiece 90. Expanding groove 29 faces second force-receiving face 92B in the second rotating direction of workpiece 90. Through provision of angle α (larger than 120°) between guiding face 251 of throat 25 and extension plane P231 including force-applying face 231 (shown in FIG. 3) and through provision of gap G between guiding face 251 of throat 25 and second force-receiving face 92A in the first rotating direction, throat 25 is not in contact with workpiece 90 and, thus, will not apply a force on workpiece 90, avoiding workpiece 90 from escaping from wrenching space 26 during wrenching of workpiece 90, and assisting jaw portion 22 in stably holding workpiece 90. Evasive portion 221 permits entrance of first force-receiving face 91B in the second rotating direction of workpiece 90.

Figure 9:
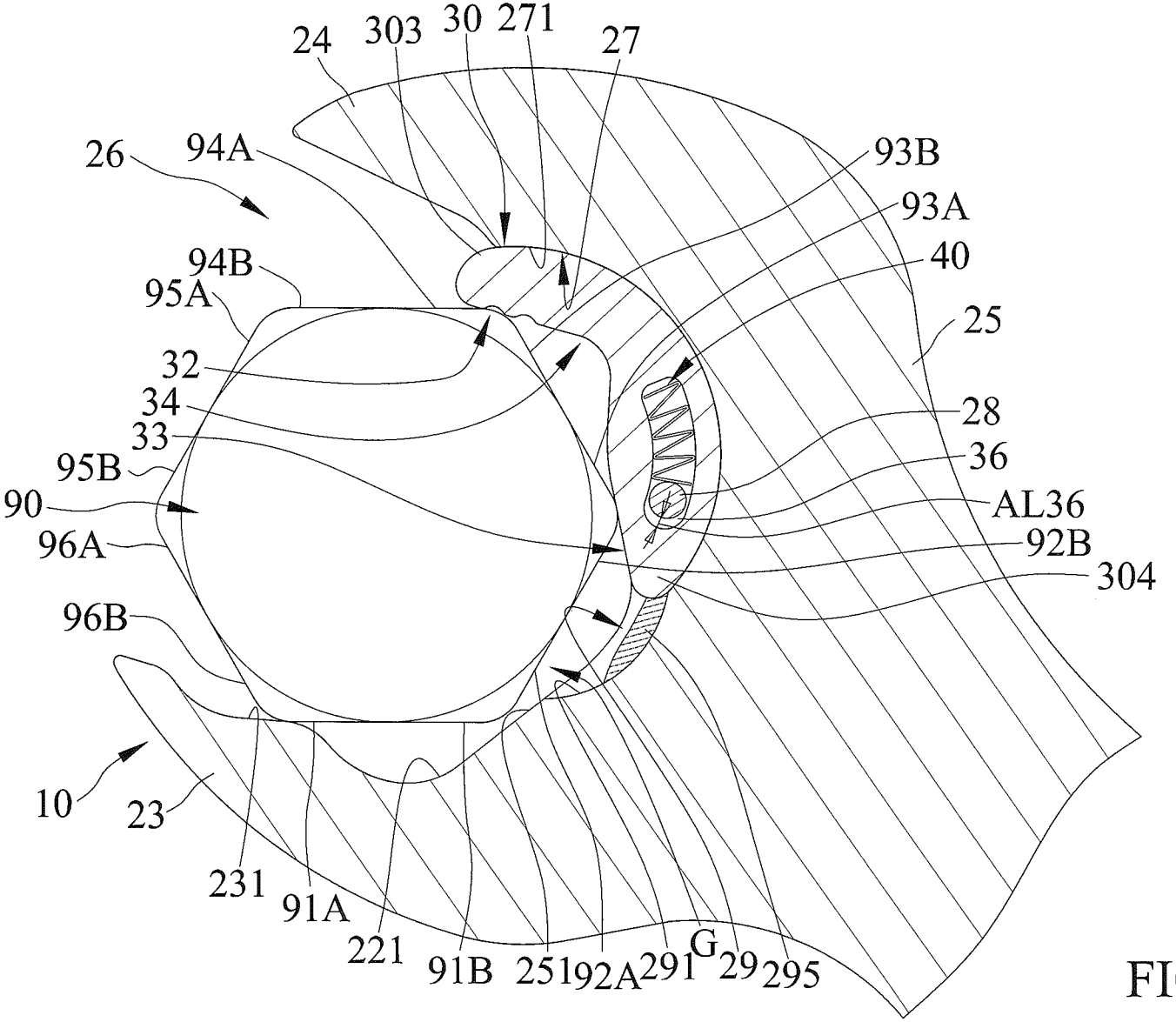
FIG. 9 is a view similar to FIG. 8, with the workpiece driven by the jaw portion to move further 10° in the clockwise direction from the position shown in FIG. 7.

FIG. 9 is a view similar to FIG. 8, with workpiece 90 driven by jaw portion 22 to move further 10° in the clockwise direction from the position shown in FIG. 7. Jaw portion 22 is subject to the reactive force of workpiece 90 and continues to deform elastically. At this time, the reactive force imparted to jaw portion 22 is still smaller than the elastic limit of jaw portion 22. Particularly, the elastic deformation of first jaw 23 continuously increases, such that the curvature of expanding wall 291 of expanding groove 29 continuously decreases to an extent which is smaller than the curvature of expanding wall 291 in FIG. 8 but is still larger than the curvature of sliding wall 271 of arcuate sliding groove 271. At this time, first wrenching face 32 of slider 30 abuts fourth force-receiving face 94A in the first rotating direction of workpiece 90. Second wrenching face 33 of slider 30 abuts third force-receiving face 93A in the first rotating direction of workpiece 90. Force-applying face 231 of first jaw 23 abuts first force-receiving face 91A in the first rotating direction. Thus, jaw portion 22 can still stably hold and rotate workpiece 90. Expanding groove 29 faces second force-receiving face 92B in the second rotating direction of workpiece 90. Through provision of angle α (larger than 120°) between guiding face 251 of throat 25 and extension plane P231 including force-applying face 231 (shown in FIG. 3) and through provision of gap G between guiding face 251 of throat 25 and second force-receiving face 92A in the first rotating direction, throat 25 is not in contact with workpiece 90 and, thus, will not apply a force on workpiece 90, avoiding workpiece 90 from escaping from wrenching space 26 during wrenching of workpiece 90, and assisting jaw portion 22 in stably holding workpiece 90. Evasive portion 221 permits entrance of first force-receiving face 91B in the second rotating direction of workpiece 90.

Figure 10:
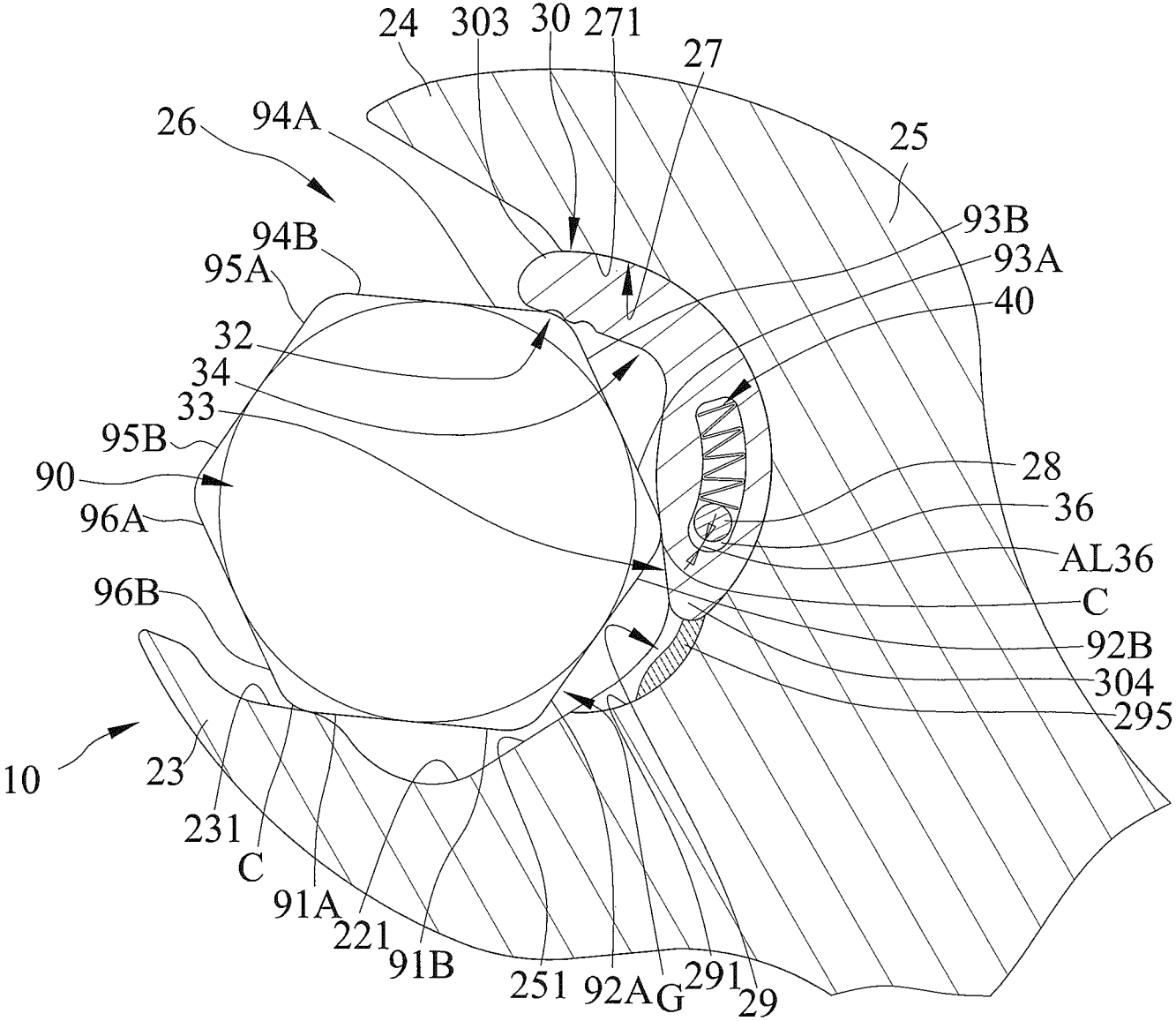
FIG. 10 is a view similar to FIG. 9, illustrating elastic expansion of the jaw portion while wrenching the workpiece.

FIG. 10 is a view similar to FIG. 9, illustrating elastic expansion of jaw portion 22 while wrenching workpiece 90. Specifically, in a demand for a higher torque, the user rotates handle 21 and, thus, rotates jaw portion 22 around the central axis of workpiece 90, such that jaw portion 22 is subject to the reactive force of workpiece 90 and continues to deform elastically. At this time, the reactive force imparted to jaw portion 22 is still smaller than the elastic limit of jaw portion 22. Particularly, the elastic deformation of first jaw 23 continuously increases, such that the curvature of expanding wall 291 of expanding groove 29 continuously decreases to an extent which is smaller than the curvature of expanding wall 291 in FIG. 9 but is still larger than the curvature of sliding wall 271 of arcuate sliding groove 27. At this time, first wrenching face 32 of slider 30 abuts fourth force-receiving face 94A in the first rotating direction of workpiece 90. Second wrenching face 33 of slider 30 abuts corner C between third force-receiving face 93A in the first rotating direction and second force-receiving face 92B in the second rotating direction of workpiece 90. Force-applying face 231 of first jaw 23 abuts first force-receiving face 91A in the first rotating direction. Thus, jaw portion 22 can still stably hold and rotate workpiece 90. Nevertheless, at this time, corner C between first force-receiving face 91A in the first rotating direction and sixth force-receiving face 96B in the second rotating direction is very close to an intersection between force-applying face 231 of first jaw 23 and evasive portion 221. Expanding groove 29 faces second force-receiving face 92A in the first rotating direction of workpiece 90. Through provision of angle α (larger than 120°) between guiding face 251 of throat 25 and extension plane P231 including force-applying face 231 (shown in FIG. 3) and through provision of gap G between guiding face 251 of throat 25 and second force-receiving face 92A in the first rotating direction, throat 25 is not in contact with workpiece 90 and, thus, will not apply a force on workpiece 90, avoiding workpiece 90 from escaping from wrenching space 26 during wrenching of workpiece 90, and assisting jaw portion 22 in stably holding workpiece 90. Evasive portion 221 permits entrance of first force-receiving face 91B in the second rotating direction of workpiece 90.

Figure 11:
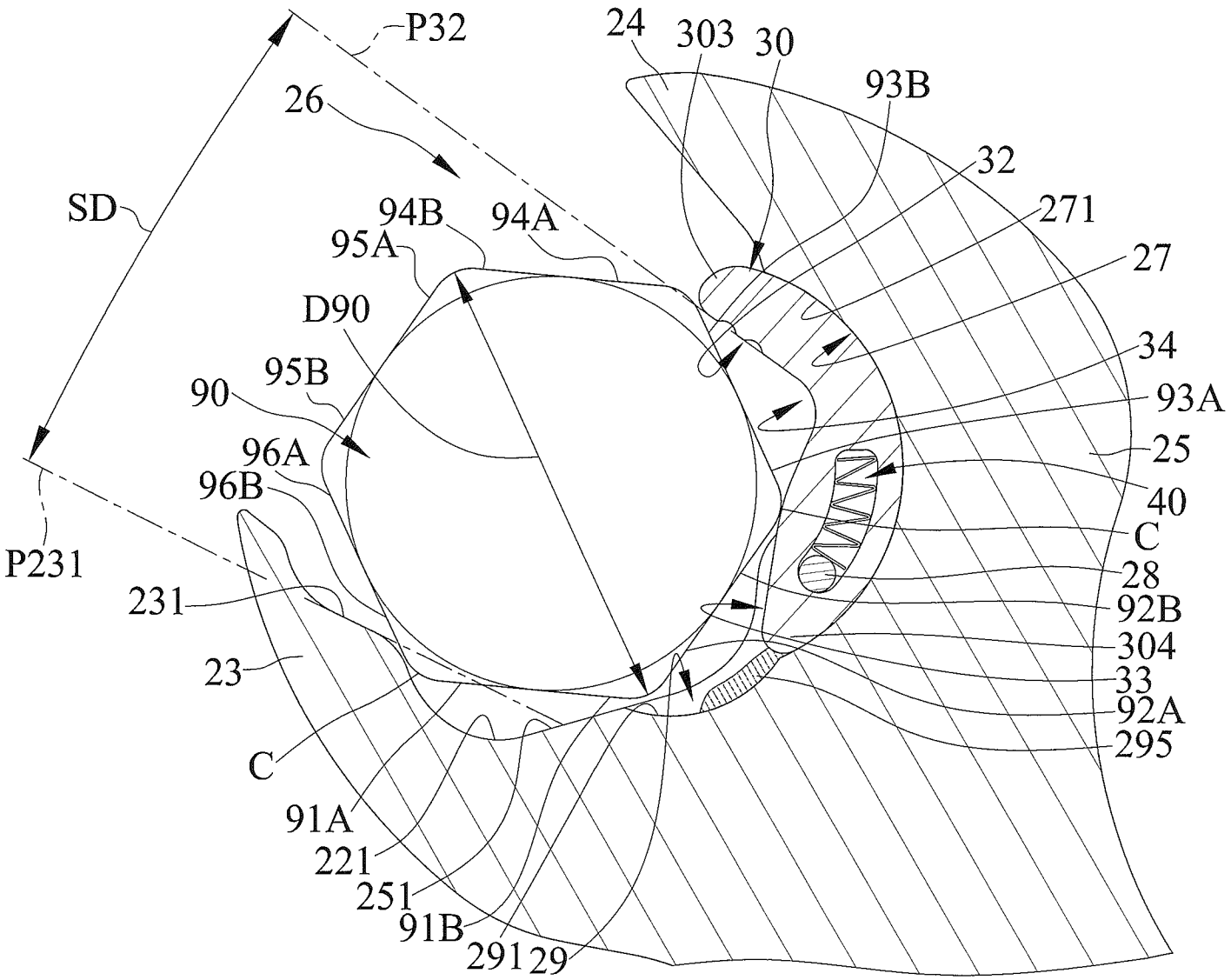
FIG. 11 is a view similar to FIG. 10, with a force-receiving face of the workpiece moved across a force-applying face of a first jaw into an evasive portion.

FIG. 11 is a view similar to FIG. 10, with a force-receiving face of workpiece 90 moved across force-applying face 231 of first jaw 23 into evasive portion 221. Specifically, in a demand for a higher torque, the user rotates handle 21 and, thus, rotates jaw portion 22 around the central axis of workpiece 90, such that jaw portion 22 is subject to the reactive force of workpiece 90 and continues to deform elastically. At this time, the reactive force imparted to jaw portion 22 is still smaller than but approximates the elastic limit of jaw portion 22 (i.e., the reactive force imparted to jaw portion 22 approaches the elastic deformation threshold of jaw portion 22). The curvature of expanding wall 291 of expanding groove 29 decreases to a minimal value within the elastic limit of jaw portion 22. The minimal value of the curvature of expanding wall 291 is still larger than the curvature of sliding wall 271 of arcuate sliding groove 271. Due to the increase in the expansion effect within the elastic limit of jaw portion 22 resulting from provision of expanding groove 29 (the significant increase is bordered at protrusion 292), jaw portion 22 has an expansion effect (within the elastic limit) at the first portion including first jaw 23, particularly at first jaw 23. Thus, in this state, a diagonal distance D90 of workpiece 90 is smaller than a smallest distance SD between second wrenching face 32 of slider 30 and force-applying face 231 of first jaw 23, which is smallest distance SD between extension plane P32 of first wrenching face 32 and extension plane P231 of force-applying face 231 (shown in FIG. 3), such that corner C between first force-receiving face 91A in the first rotating direction and sixth force-receiving face 96B in the second rotating direction of workpiece 90 moves across force-applying face 231 of first jaw 23 and enters evasive portion 221 under the high torque. At this time, first wrenching face 32 of slider 30 disengages from fourth force-receiving face 94A in first rotating direction of the workpiece 90, and second wrenching face 33 of slider 30 abuts corner C between third force-receiving face 93A in the first rotating direction and second force-receiving face 92B in the second rotating direction of workpiece 90, preventing damage to slider 30 and first jaw 23 resulting from failing to withstand the reactive force from workpiece 90. Expanding groove 29 faces second force-receiving face 92A in the first rotating direction of workpiece 90. Through provision of angle α (larger than 120°) between guiding face 251 of throat 25 and extension plane P231 including force-applying face 231 (shown in FIG. 3) and through provision of gap G between guiding face 251 of throat 25 and second force-receiving face 92A in the first rotating direction, after corner C between first force-receiving face 91A in the first rotating direction and sixth force-receiving face 96B in the second rotating direction moves across force-applying face 231 of first jaw 23, even if corner C between second force-receiving face 92A in the first rotating direction and first force-receiving face 91B in the second rotating direction or corner C between first force-receiving face 91A in the first rotating direction and sixth force-receiving face 96B in the second rotating direction is in contact with guiding face 251, corner C of workpiece 90 can still smoothly move relative to wrenching space 26 under guidance of guiding face 251.

Figure 12:
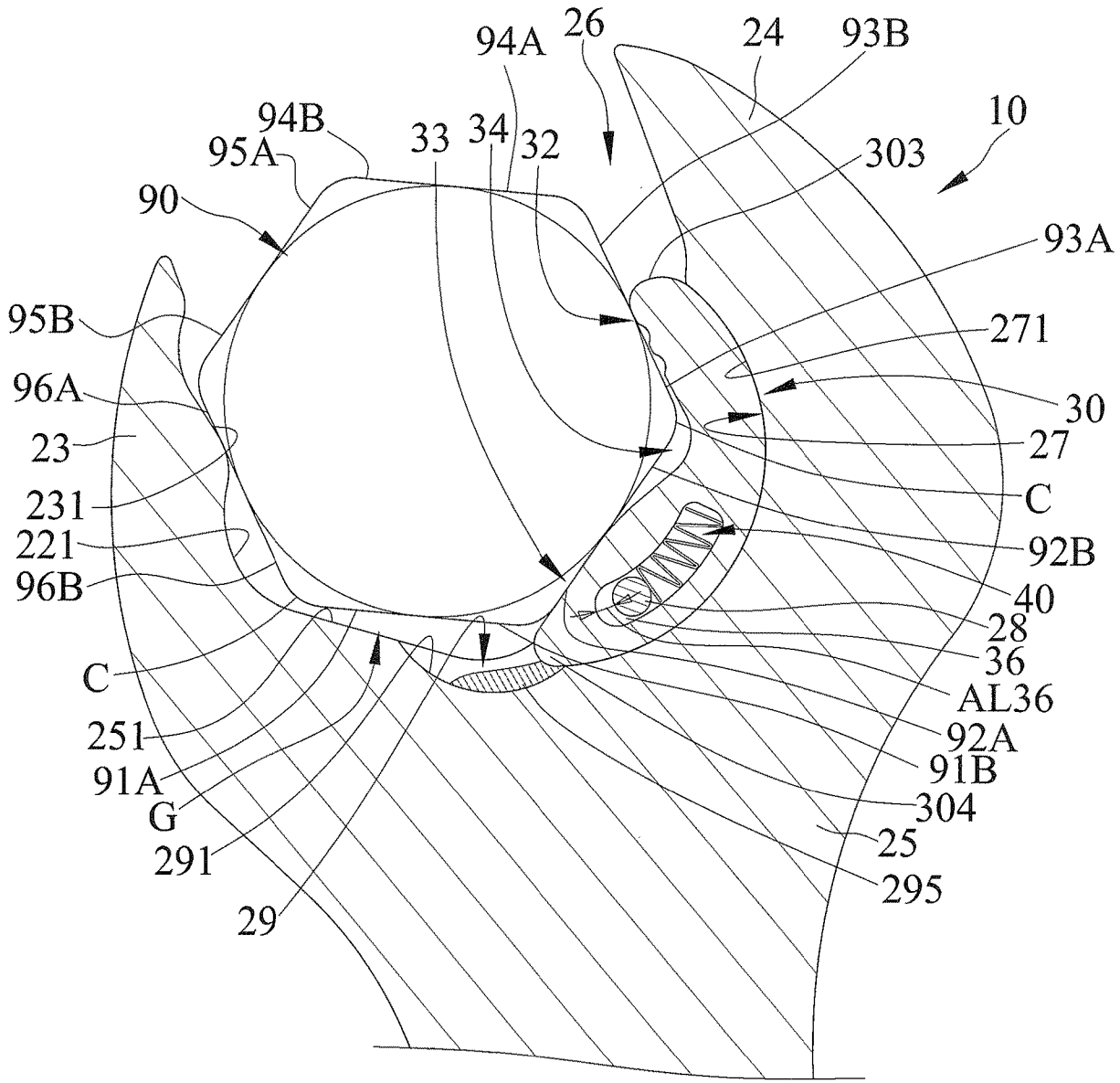
FIG. 12 is a view similar to FIG. 11, with the jaw portion restoring the shape shown in FIG. 4 after a reactive force from the workpiece is removed.

FIG. 12 is a view similar to FIG. 11, with jaw portion 22 restoring the shape shown in FIG. 4 after a reactive force from the workpiece is removed. After corner C between first force-receiving face 91A in the first rotating direction and sixth force-receiving face 96B in the second rotating direction of workpiece 90 moves across force-applying face 231 of first jaw 23 and enters evasive portion 221, the user cannot further wrench workpiece 90. No force is applied to workpiece 90. Since the reactive force imparted to jaw portion 22 is smaller than the elastic limit of jaw portion 22 during wrenching of wrench 90, jaw portion 22 in FIG. 12 elastically restores the shape shown in FIG. 4.

As can be seen from FIGS. 5-12 showing movements of open end wrench 10 according to the present invention, when open end wrench 10 is used to rotate the workpiece 90 with a high torque, jaw portion 22 deforms elastically within the elastic limit of jaw portion 22. Since protrusion 292 of expanding groove 29 is located in a center of jaw portion 22 (namely, an arcuate processing is carried out at the location where a conventional open end wrench is apt to break, forming expanding groove 29), when the force applied to jaw portion 22 reaches 80% of the rigidity of jaw portion 22, expansion groove 29 permits jaw portion 22 to start the elastic deformation, and jaw portion 22 will not break unless the force exceeds 100% of the rigidity of jaw portion 22 (which is the elastic limit of jaw portion 22). Of more importance, the service life of open end wrench 10 according to the present invention is longer than that of conventional open end wrenches by 30% after service life tests. This effectively avoids the problem of conventional open end wrenches that are apt to instantly break when subject to a force reaching 80%-100% of the rigidity.

Since expanding groove 29 increases the expansion effect of the first portion including first jaw 23 of jaw portion 22 within the elastic limit, the deformation capacity of first jaw 23 is larger than the deformation capacity of second jaw 24. Furthermore, since the width of second jaw 24 in the width direction is larger than the width of first jaw 23 in the width direction, wrenching space 26 gradually expands in response to the reactive force from workpiece 90. Due to provision of expanding groove 29, the expansion effect of jaw portion 22 within the elastic limit is increased, especially the significant increase in the expansion effect of first jaw 23 within the elastic limit. When the elastic limit threshold of jaw portion 22 is reached, diagonal distance D90 of workpiece 90 is smaller than smallest distance SD between second wrenching face 32 of slider 30 and force-applying face 231 of first jaw 23, such that corner C between first force-receiving face 91A in the first rotating direction and sixth force-receiving face 96B in the second rotating direction of workpiece 90 can move across force-applying face 231 of first jaw 23 and can enter evasive portion 221 under the high torque, preventing damage to slider 30 and first jaw 23 resulting from failing to withstand the reactive force from workpiece 90, thereby achieving the effect of having high toughness and a long service life.

Furthermore, through provision of angle α (larger than 120°) between guiding face 251 of throat 25 and extension plane P231 including force-applying face 231 and through provision of gap G between guiding face 251 of throat 25 and second force-receiving face 92A in the first rotating direction, throat 25 is not in contact with workpiece 90 and, thus, will not apply a force on workpiece 90, avoiding workpiece 90 from escaping from wrenching space 26 during wrenching of workpiece 90, and assisting jaw portion 22 in stably holding workpiece 90. Furthermore, the provision of angle α (larger than 120°) between guiding face 251 of throat 25 and extension plane P231 including force-applying face 231 avoids excessive variation in angle α during processing of jaw portion 22 (angle α not equal to 120° but larger than 120° is sufficient). This avoids throat 25 from forcing workpiece 90 to escape from wrenching space 26.

Moreover, through provision of angle α (larger than 120°) between guiding face 251 of the throat 25 and the extension plane P231 including the force-applying face 231 and through provision of gap G between guiding face 251 of throat 25 and second force-receiving face 92A in the first rotating direction, after corner C between first force-receiving face 91A in the first rotating direction and sixth force-receiving face 96B in the second rotating direction passes through force-applying face 231 of first jaw 23, even if corner C between second force-receiving face 92A in the first rotating direction and first force-receiving face 91B in the second rotating direction or corner C between first force-receiving face 91A in the first rotating direction and sixth force-receiving face 96B in the second rotating direction is in contact with guiding face 251, corner C of workpiece 90 can still smoothly move relative to wrenching space 26 under guidance of guiding face 251.

Therefore, the design philosophy of the hand tool does not seek rigidity blindly, but should lay equal stress on rigidity and toughness to become the winner. This is the Know-how that the general hand tool factory does not know.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. An open end wrench capable of fast driving a workpiece and having high toughness and a long service life, wherein the workpiece includes an outer periphery having first, second, third, fourth, fifth, and sixth sides respectively having first, second, third, fourth, fifth, and sixth faces in a first rotating direction and respectively having first, second, third, fourth, fifth, and sixth force-receiving faces in a second rotating direction, wherein the first force-receiving face in the first rotating direction and the first force-receiving face in the second rotating direction of the workpiece are coplanar, wherein the first force-receiving face in the first rotating direction and the fourth force-receiving face in the first rotating direction of the workpiece are located at two opposite sides of the workpiece, wherein a corner is formed between the first force-receiving face in the first rotating direction and the sixth force-receiving face in the second rotating direction and has an angle of 120°, with the open end wrench comprising:

a body including a handle and a jaw portion formed on an end of the handle, wherein spaced first and second jaws are formed on an end of the jaw portion opposite to the handle, wherein the jaw portion includes a throat intermediate the first and second jaws, wherein the first and second jaws and the throat together define a wrenching space adapted to receive the working piece, wherein the first jaw includes a force-applying face facing the wrenching space and the second jaw, wherein a first evasive portion is formed between the force-applying face of the first jaw and the throat, wherein the jaw portion further includes an arcuate sliding groove at a side of the second jaw facing the wrenching space, wherein a guiding pin is fixed in the arcuate sliding groove, and wherein the jaw portion further includes an expanding groove at a side of the first jaw facing the wrenching space;

a slider slideably received in the arcuate sliding groove and slideable along an arcuate path, wherein the slider includes a first end and a second end opposite to the first end, wherein the first end of the slider includes a first wrenching face located outside of the arcuate sliding groove, wherein the slider further includes a guiding slot that is arcuate, wherein the guiding pin is received in the guiding slot, preventing the slider from disengaging from the arcuate sliding groove, wherein the guiding slot includes an abutting end, and wherein when the slider is in a free position, the abutting end of the guiding slot is in contact with the guiding pin; and an elastic device mounted between the body and the slider and biasing the slider to the free position, wherein when the workpiece is not received in the jaw portion, the slider is in the free position, the first wrenching face of the slider extends into the wrenching space, and the first wrenching face of the slider is not parallel to the force-applying face of the first jaw, wherein when the jaw portion receives the workpiece but does not drive workpiece, the jaw portion abuts the first force-receiving face in the first rotating direction by the force-applying face of the first jaw, the first end of the slider abuts the fourth force-receiving face in the first rotating direction of the workpiece, and the expanding groove faces the second force-receiving face in the second rotating direction of the workpiece, and wherein when the workpiece is wrenched by the jaw portion and causes deformation of the jaw portion, the expanding groove increases an expansion effect of the jaw portion within an elastic limit of the jaw portion, such that the corner between the first force-receiving face in the first rotating direction and the sixth force-receiving face in the second rotating direction of the workpiece moves across the force-applying face of the first jaw and enters the evasive portion, preventing damage to the slider and the first jaw resulting from failing to withstand a reactive force from the workpiece.

2. The open end wrench as claimed in claim 1, wherein the throat includes a guiding face facing the wrenching space, wherein a gap is formed between the guiding face of the throat and the second force-receiving face in the first rotating direction, wherein the evasive portion is formed between the force-applying face of the first jaw and the guiding face of the throat, and wherein an angle larger than 120° is formed between the guiding face of the throat and an extension plane including the force-applying face, such that after the corner between the first force-receiving face in the first rotating direction and the sixth force-receiving face in the second rotating direction moves across the force-applying face of the first jaw, the workpiece is smoothly movable relative to the wrenching space through the provision of the guiding face and the gap.

3. The open end wrench as claimed in claim 2, wherein the angle between the guiding face of the throat and the extension plane including the force-applying face is larger than 130°.

4. The open end wrench as claimed in claim 3, wherein the expanding groove is arcuate and intercommunicates with the arcuate sliding groove, wherein the jaw portion includes a protrusion at an intersection between the arcuate sliding groove and the expanding groove, and wherein an end of the arcuate sliding groove adjacent to the expanding groove is not connected to an inner wall of the throat facing the wrenching space.

5. The open end wrench as claimed in claim 4, wherein the arcuate sliding groove includes a sliding wall that is concave and arcuate, wherein the sliding wall is free of holes, grooves, and recesses and has a concave, arcuate face, wherein the expanding groove includes an expanding wall that is concave and arcuate, wherein the expanding wall is free of holes, grooves, and recesses and has a concave, arcuate face, and wherein a curvature of the expanding wall is larger than a curvature of the sliding wall.

6. The open end wrench as claimed in claim 5, wherein the expanding groove further includes a first retaining wall located at a top of the expanding wall and a second retaining wall located at a bottom of the expanding wall and opposite to the first retaining wall, wherein the first and second retaining walls are parallel to each other, and wherein the arcuate sliding groove and the expanding groove have a same height.

7. The open end wrench as claimed in claim 6, wherein a sliding face is formed on a side of the slider, is convex and arcuate, and is smoothly slideable along the sliding wall of the arcuate sliding groove, wherein the arcuate sliding groove further includes a first supporting wall located at a top of the sliding wall and a second supporting wall located at a bottom of the sliding wall and opposite to the first supporting wall, wherein the first supporting wall and the second supporting wall are parallel to each other, wherein two ends of the guiding pin are respectively fixed to the first and second supporting wall, wherein the slider includes a top face and a bottom face, wherein the top and bottom faces are symmetrically supported by the first and second supporting walls, avoiding wobbling of the slider while sliding in the arcuate sliding groove along the arcuate path, wherein the guiding slot extends from the top face through the bottom face, wherein the guiding slot is free of holes, grooves, and recesses, wherein the guiding slot further includes a pressing end opposite to the abutting end, wherein two ends of the elastic device respectively abut the guiding pin and the pressing end of the guiding slot, wherein a grease is applied to the expanding wall and the protrusion of the expanding groove, wherein when the slider slides relative to the arcuate sliding groove along the arcuate path, the grease on the protrusion is drawn by the sliding face to move from the second end of the slider to a position between the sliding face and the sliding wall, reducing sliding friction between the slider and the arcuate sliding groove.

8. The open end wrench as claimed in claim 7, wherein the first end of the slider includes two wings respectively extending away from the top and bottom faces, wherein each of the two wings includes inner and outer faces, wherein each of the inner faces of the two wings is configured to wrench the workpiece, wherein the open end wrench is configured to contact a whole height of a head of the workpiece with the first wrenching face and the two wings of the slider, increasing a contact area between the workpiece and the slider, and wherein each of the outer faces of the two wings is not in contact with the body to avoid friction with the body and to permit smooth and agile reciprocating movement of the slider, preventing the slider from getting stuck.

9. The open end wrench as claimed in claim 8, wherein each of the inner faces of the two wings includes an extending face coplanar to the first wrenching face, and wherein when the workpiece is wrenched by the jaw portion, the outer faces of the two wings are not in contact with the jaw portion to permit smooth and agile extending and retracting movements of the slider and to prevent the slider from getting stuck, such that the whole height of the head of the workpiece is in contact with the first wrenching face and each extending face of the slider through each of the two wings, increasing the contact area between the workpiece and the slider.

10. The open end wrench as claimed in claim 7, wherein the elastic device includes an elastic element mounted in the guiding slot, wherein the top and bottom faces of the slider are parallel to each other and have a height therebetween in a height direction of the slider perpendicular to the width direction, wherein the height of the slider is smaller or equal to the height of the arcuate sliding groove, wherein the guiding slot has a slot height in the height direction of the slider equal to the height of the slider, wherein the guiding slot has a width, wherein the width of the guiding slot is larger than or equal to a diameter of the guiding pin, wherein the slot height of the guiding slot is larger than 1.5 times the width of the guiding slot, wherein the elastic element of the elastic device in the guiding slot has a height in the height direction of the slider not larger than the slot height of the guiding slot, wherein the height of the elastic element is larger than the width of the guiding slot and larger than 0.5 times the slot height of the guiding slot, wherein the elastic element is a resilient plate having a plurality of force-accumulating units each in a form of a metal sheet, wherein each of the plurality of force-accumulating units has V-shaped cross sections, wherein each of the plurality of force-accumulating units includes a first end, a second end and a compressing portion between the first and second ends, wherein the compressing portion is configured to store energy after the first and second ends are compressed, such that each of the plurality of force-accumulating units has an elastic storing ability, wherein the first end of each of the plurality of force-accumulating units is connected to the second end of another of the plurality of force-accumulating units, such that the compressing portion of each of the plurality of force-accumulating units has the elastic storing ability, wherein one of first ends at an end of the elastic element abuts the guiding pin, and wherein one of the second ends at another end of the elastic element abuts the pressing end of the guiding slot.

11. The open end wrench as claimed in claim 5, wherein when the jaw portion receives the workpiece but does not wrench workpiece, a buffering space is formed between the abutting end of the guiding slot and the guiding pin, wherein the buffering space has an arc length, wherein the arc length of the buffering space is larger than a dimensional tolerance of the workpiece, wherein when the workpiece is wrenched by the jaw portion and causes deformation of the jaw portion, the body rotates relative to the workpiece, wherein the buffering space of the slider avoids the slider from rotating together with the body, and wherein when the jaw portion expands elastically, the buffering space of the slider allows the first end of the slider to still abut the fourth force-receiving face in the first rotating direction of the workpiece.

12. The open end wrench as claimed in claim 11, the arc length of the buffering space is larger than a half of a diameter of the guiding pin.

13. The open end wrench as claimed in claim 12, wherein when the jaw portion receives the workpiece but does not wrench the workpiece, the second end of the slider abuts the third force-receiving face in the first rotating direction of the workpiece, and wherein when the jaw portion expands elastically, the buffering space allows the force-applying face and the first wrenching face to respectively abut the first force-receiving face in the first rotating direction and the fourth force-receiving face in the first rotating direction of the workpiece.

14. The open end wrench as claimed in claim 13, wherein when the jaw portion receives the workpiece but does not wrench the workpiece, a buffering angle is formed between the first wrenching face of the slider and the fourth force-receiving face in the first rotating direction of workpiece, and wherein the buffering angle allows the body and the slider to gradually rotate relative to the workpiece when the jaw portion expands elastically, such that the first wrenching face of the slider abuts the fourth force-receiving face in the first rotating direction of the workpiece, providing a surface contact between the first wrenching face of the slider and the fourth force-receiving face in the first rotating direction of the workpiece.

15. The open end wrench as claimed in claim 14, wherein the buffering angle is larger than 2° and smaller than 4°.

16. The open end wrench as claimed in claim 11, the first wrenching face of the slider includes at least one V-shaped toothed groove, and wherein the at least one V-shaped toothed groove increases friction between the first wrenching face of the slider and the fourth force-receiving face in the first rotating direction of workpiece.

17. The open end wrench as claimed in claim 11, wherein a sliding face is formed on a side of the slider, is convex and arcuate, and is smoothly slideable along the sliding wall of the arcuate sliding groove, wherein the second end of the slider includes a second wrenching face located outside of the arcuate sliding groove, wherein the first and second wrenching faces are formed at a side of the slider opposite to the sliding face, wherein the slider further includes an evasive portion between the first and second wrenching faces, and wherein the evasive portion of the slider is configured to permit entrance of the third force-receiving face in the second rotating direction of the workpiece.

18. The open end wrench as claimed in claim 17, wherein the sliding face of the slider has a curvature identical to a curvature of the sliding wall of arcuate sliding groove to allow smooth sliding of the sliding face on the sliding wall, and wherein when the slider is subject to a reactive force from the workpiece, the reactive force from the workpiece is transmitted to the sliding wall through a large area of the sliding face when the workpiece is wrenched by the body while avoiding stress concentration of the sliding and thereby increasing a torque bearing capacity of the slider.

19. The open end wrench as claimed in claim 18, wherein the guiding slot has a curvature identical to the curvature of the sliding wall of the arcuate sliding groove, providing smooth arcuate sliding movement between the guiding slot of the slider and the guiding pin in the arcuate sliding groove, and avoiding interference between the slider, the guiding pin and the sliding wall.

20. The open end wrench as claimed in claim 1, wherein the first and second jaws are integrally formed on the two ends of the jaw portion and opposite to each other, wherein a width of the second jaw in a width direction is larger than a width of the first jaw in the width direction to provide the jaw portion with good structural toughness, thereby increasing a torque bearing capacity of the jaw portion.

* * * * *